US012723784B2

(12) United States Patent
Jang et al.

(10) Patent No.: US 12,723,784 B2
(45) Date of Patent: Sep. 1, 2026

(54) AIR CONDITIONER

(71) Applicant: LG ELECTRONICS INC., Seoul (KR)

(72) Inventors: Jiyoung Jang, Seoul (KR); Yongcheol Sa, Seoul (KR); Chiwoo Song, Seoul (KR); Jisung Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 57 days.

(21) Appl. No.: 18/656,865

(22) Filed: May 7, 2024

(65) Prior Publication Data

US 2024/0377109 A1 Nov. 14, 2024

(30) Foreign Application Priority Data

May 12, 2023 (KR) ..... 10-2023-0061871

(51) Int. Cl.
*F25B 13/00* (2006.01)

(52) U.S. Cl.
CPC ..... *F25B 13/00* (2013.01); *F25B 2313/003* (2013.01); *F25B 2313/006* (2013.01); *F25B 2313/007* (2013.01); *F25B 2313/0233* (2013.01); *F25B 2313/02742* (2013.01); *F25B 2313/0292* (2013.01)

(58) Field of Classification Search
CPC ..... F25B 13/00; F25B 2313/003; F25B 2313/006; F25B 2313/007; F25B 2313/02742; F25B 2313/0292; F25B 2313/0231; F25B 49/02; F25B 5/02; F25B 6/02; F25B 41/20; F25B 41/40
See application file for complete search history.

(56) References Cited

U.S. PATENT DOCUMENTS

| | | | | |
|---|---|---|---|---|
| 2006/0075942 | A1* | 4/2006 | Tak | A47B 41/02 108/103 |
| 2020/0318875 | A1* | 10/2020 | Yamada | F25B 6/02 |
| 2022/0065505 | A1* | 3/2022 | Jung | F24F 1/0003 |
| 2022/0214056 | A1* | 7/2022 | Yoshimi | F24F 3/06 |

FOREIGN PATENT DOCUMENTS

| | | | | |
|---|---|---|---|---|
| JP | 7459381 | B2 * | 4/2024 | F24F 11/83 |
| KR | 20060075942 | A * | 7/2006 | F25B 41/20 |
| KR | 20130134347 | A * | 12/2013 | |
| KR | 10-2018-0055362 | | 5/2018 | |
| WO | WO-2020152837 | A1 * | 7/2020 | F24F 11/56 |
| WO | WO-2022264254 | A1 * | 12/2022 | F24F 11/83 |

* cited by examiner

*Primary Examiner* — Emmanuel E Duke
(74) *Attorney, Agent, or Firm* — KED & ASSOCIATES

(57) ABSTRACT

An air conditioner of the present disclosure includes one or more outdoor units comprising a compressor and an outdoor heat exchanger which exchanges heat between a refrigerant flowing through the compressor and external air; and a plurality of indoor units which are connected to the outdoor unit, and have an indoor heat exchanger, wherein the plurality of indoor units include a first indoor unit group and a second indoor unit group, wherein the outdoor unit and the first indoor unit group are connected by a first gas pipe and a liquid pipe, and wherein the outdoor unit and the second indoor unit group are connected by a second gas pipe and the liquid pipe.

12 Claims, 19 Drawing Sheets

AIR CONDITIONER

CROSS-REFERENCE TO RELATED PATENT APPLICATIONS

The present application claims priority under 35 U.S.C. 119 and 35 U.S.C. 365 to Korean Patent Application No. 10-2023-0061871, filed on May 12, 2023, which is hereby incorporated by reference in its entirety.

TECHNICAL FIELD

This disclosure relates to an air conditioner, and more particularly, to an air conditioner capable of performing a simultaneous heating and cooling operation.

BACKGROUND

Nowadays, in order to more efficiently cool or heat an indoor space divided into multiple rooms, the development of multi-air conditioner that operates cooling or heating for each room is continuously being developed.

An air conditioner may be connected to an outdoor unit and a plurality of indoor units. Depending on a connection method of a plurality of indoor and an outdoor unit, it can be used as a switching air conditioner or a simultaneous air conditioner.

In a simultaneous air conditioner, one outdoor unit is connected to a plurality of indoor units by three refrigerant pipes, and each of the plurality of indoor units can be operated simultaneously for cooling and heating. To this end, the simultaneous air conditioner has a distributor between the outdoor unit and the indoor unit, provides condensed refrigerant to the indoor unit in a room requiring cooling to cool the room, and provides compressed refrigerant to the indoor unit in a room requiring heating to heat the room.

Republic of Korea Patent Publication No. 10-2018-0055362 and U.S. Patent Publication No. 2022-0214056 disclose a simultaneous air conditioner having a distributor.

In a conventional simultaneous cycle in a prior literature, three pipes of a high-pressure gas pipe, a low-pressure gas pipe, and a liquid pipe emerge from the outdoor unit and are connected to a distributor unit. The conventional simultaneous cycle has a structure in which a refrigerant flow path is formed with a low-pressure pipe and a liquid pipe in the indoor unit that requires cooling, and a refrigerant flow path is formed with a high-pressure pipe and a liquid pipe in the indoor unit that requires heating according to the opening and closing of the high pressure valve and the low pressure valve inside the distributor unit.

In the conventional simultaneous cycle, a lot of piping is required between the distributor unit and the outdoor unit, and between the distributor unit and the indoor unit, which complicates the installation piping, requires securing the installation space of the distributor unit, and increases the installation cost due to many welding points.

In addition, in many cases, the distributor unit is installed indoors, and when a valve is opened, impact noise may occur due to the pressure difference of the refrigerant, etc. and such noise may cause discomfort to a user.

SUMMARY

The disclosure has been made in view of the above problems, and may provide an air conditioner that can be operated simultaneously for cooling and heating and in various operating modes without a distributor.

The disclosure may further provide an air conditioner that can be operated simultaneously while reducing manufacturing costs, installation costs, and installation space.

The disclosure may further provide a simultaneous air conditioner capable of controlling indoor units for each group.

The disclosure may further provide an air conditioner that can be effectively operated simultaneously according to the load occurring in a plurality of indoor units.

The disclosure may further provide an air conditioner that can be operated in response to load fluctuations occurring in a plurality of indoor units.

The disclosure may further provide an air conditioner that can be operated with a high-efficiency heat recovery while simultaneously implementing a hot water heating operation and a cooling operation.

In an air conditioner according to an embodiment of the present disclosure, an outdoor unit and indoor units are connected by a gas pipe and a common liquid pipe, and the gas pipe flows a high-pressure or low-pressure refrigerant depending on the operation mode of connected indoor unit, so that simultaneous operation is possible without a distributor.

In the air conditioner according to an embodiment of the present disclosure, a plurality of indoor units are divided into two or more groups, and each group is connected to the outdoor unit, by two pipes including the gas pipe and common liquid pipe, so that simultaneous operation is possible between groups.

The air conditioner according to an embodiment of the present disclosure can operate more effectively by connecting a dedicated heating indoor unit and an indoor unit for both cooling and heating to other gas pipe.

The air conditioner according to an embodiment of the present disclosure includes: one or more outdoor units including a compressor and an outdoor heat exchanger which exchanges heat between a refrigerant flowing through the compressor and external air; and a plurality of indoor units which are connected to the outdoor unit, and have an indoor heat exchanger, wherein the plurality of indoor units comprise a first indoor unit group and a second indoor unit group, wherein the outdoor unit and the first indoor unit group are connected by a first gas pipe and a liquid pipe, and wherein the outdoor unit and the second indoor unit group are connected by a second gas pipe and the liquid pipe.

The first gas pipe flows a high-temperature and high-pressure refrigerant or a low-temperature and low-pressure refrigerant, depending on an operation mode of the first indoor unit group, and the second gas pipe flows a high-temperature and high-pressure refrigerant or a low-temperature and low-pressure refrigerant, depending on an operation mode of the second indoor unit group.

The outdoor heat exchanger is used as a condenser or evaporator, based on a load of the first and second indoor unit groups.

A current mode of the outdoor heat exchanger is maintained, when a difference between an evaporation heat amount and a condensation heat amount required according to the load of the first and second indoor unit groups is in a heat balance state within a preset standard value.

The outdoor unit includes a plurality of heat exchangers, and in case of not the heat balance state, when there exists a heat exchanger capable of switching a mode to the condenser or the evaporator, switches a mode of a corresponding heat exchanger, and maintains a current mode of the outdoor heat exchanger, when a heat exchanger capable of switching a mode to the condenser or the evaporator does not exist.

The air conditioner according to an embodiment of the present disclosure further includes a plurality of outdoor units, wherein in case of not the heat balance state, when there exists an outdoor unit capable of switching a mode to the condenser or the evaporator, an outdoor heat exchanger mode of a corresponding outdoor unit is switched, and when an outdoor unit capable of switching a mode to the condenser or the evaporator does not exist, a current mode of the outdoor heat exchanger is maintained.

The air conditioner according to an embodiment of the present disclosure further includes a switching valve which transmits a refrigerant discharged from the compressor to at least one of the outdoor heat exchanger and an indoor heat exchanger disposed inside the plurality of indoor units.

In the air conditioner according to an embodiment of the present disclosure, the first and second indoor unit groups are indoor units for both cooling and heating.

In the air conditioner according to an embodiment of the present disclosure, the first indoor unit group is composed of a dedicated heating indoor unit, and the second indoor unit group is composed of an indoor unit for both cooling and heating.

The first indoor unit group is composed of a dedicated heating indoor unit, and the first gas pipe flows a high-temperature and high-pressure refrigerant, depending on whether the first indoor unit group is operating.

The second gas pipe flows a high-temperature and high-pressure refrigerant or a low-temperature and low-pressure refrigerant, depending on an operation mode of the second indoor unit group.

The air conditioner according to an embodiment of the present disclosure further includes a first switching valve which switches the outdoor heat exchanger to a condenser or an evaporator; and a second switching valve which switches the second gas pipe into a high-pressure pipe or a low-pressure pipe.

When the first indoor unit group performs a heating operation and the second indoor unit group performs a cooling operation, if a heating load is larger, the first switching valve is turned on, and the outdoor heat exchanger is used as an evaporator.

When the first indoor unit group is turned off and the second indoor unit group is operating, the first switching valve is turned off, and the outdoor heat exchanger is used as a condenser.

When the first indoor unit group performs a heating operation and the second indoor unit group performs a cooling operation, if a cooling load is larger, the first switching valve is turned off, and the outdoor heat exchanger is used as a condenser.

When the second indoor unit group is turned off and the first indoor unit group is operating, the first switching valve is turned on, and the outdoor heat exchanger is used as an evaporator.

When the first and second indoor unit groups perform a heating operation, the first switching valve is turned on, and the outdoor heat exchanger is used as an evaporator, and the first and second indoor unit groups are freely turned on or off without switching the first switching valve, while an indoor unit of other group is operating.

A current mode of the first switching valve is maintained, when a difference between an evaporation heat amount and a condensation heat amount required according to a load of the first and second indoor unit groups is in a heat balance state within a preset standard value.

The air conditioner according to an embodiment of the present disclosure includes: one or more outdoor units including a compressor and an outdoor heat exchanger which exchanges heat between a refrigerant flowing through the compressor and external air; and a plurality of indoor units which are connected to the outdoor unit, and have an indoor heat exchanger, wherein the plurality of indoor units include a first indoor unit group composed of a dedicated heating indoor unit and a second indoor unit group composed of an indoor unit for both heating and cooling, wherein the outdoor unit and the first indoor unit group are connected by a first gas pipe and a liquid pipe, and wherein the outdoor unit and the second indoor unit group are connected by a second gas pipe and the liquid pipe.

At this time, the first gas pipe flows a high-temperature and high-pressure refrigerant depending on whether the first indoor unit group is operating, and the second gas pipe flows a high-temperature and high-pressure refrigerant or a low-temperature and low-pressure refrigerant, depending on an operation mode of the second indoor unit group.

In addition, the air conditioner of the present disclosure further includes: a first switching valve which switches the outdoor heat exchanger to a condenser or an evaporator; and a second switching valve which switches the second gas pipe to a high-pressure pipe or a low-pressure pipe.

BRIEF DESCRIPTION OF THE DRAWINGS

The above and other objects, features and advantages of the present disclosure will be more apparent from the following detailed description in conjunction with the accompanying drawings, in which.

DETAILED DESCRIPTION

Description will now be given in detail according to exemplary embodiments disclosed herein, with reference to the accompanying drawings. For the sake of brief description with reference to the drawings, the same or equivalent components may be denoted by the same reference numbers, and description thereof will not be repeated.

In general, suffixes such as "module" and "unit" may be used to refer to elements or components. Use of such suffixes herein is merely intended to facilitate description of the specification, and the suffixes do not have any special meaning or function.

It will be understood that although the terms first, second, etc. may be used herein to describe various elements, these elements should not be limited by these terms. These terms are only used to distinguish one element from another.

It will be understood that when an element is referred to as being "connected with" another element, there may be intervening elements present. In contrast, it will be understood that when an element is referred to as being "directly connected with" another element, there are no intervening elements present.

Hereinafter, an air conditioner according to an embodiment of the present disclosure will be described with reference to the drawings.

Figure 1A:
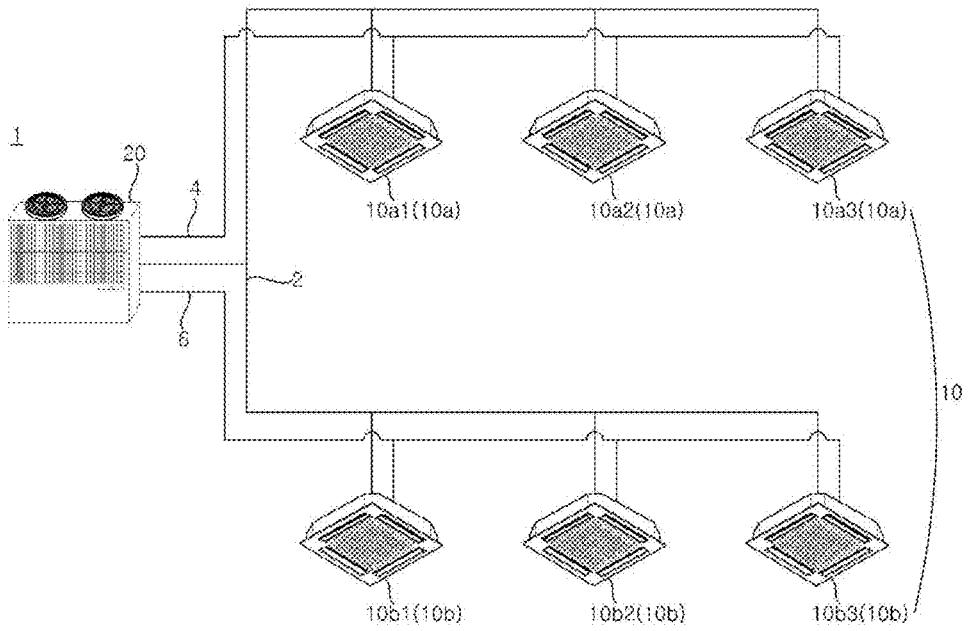
FIGS. 1A and 1B are system configuration diagrams of an air conditioner according to an embodiment of the present disclosure.
Figure 1B:
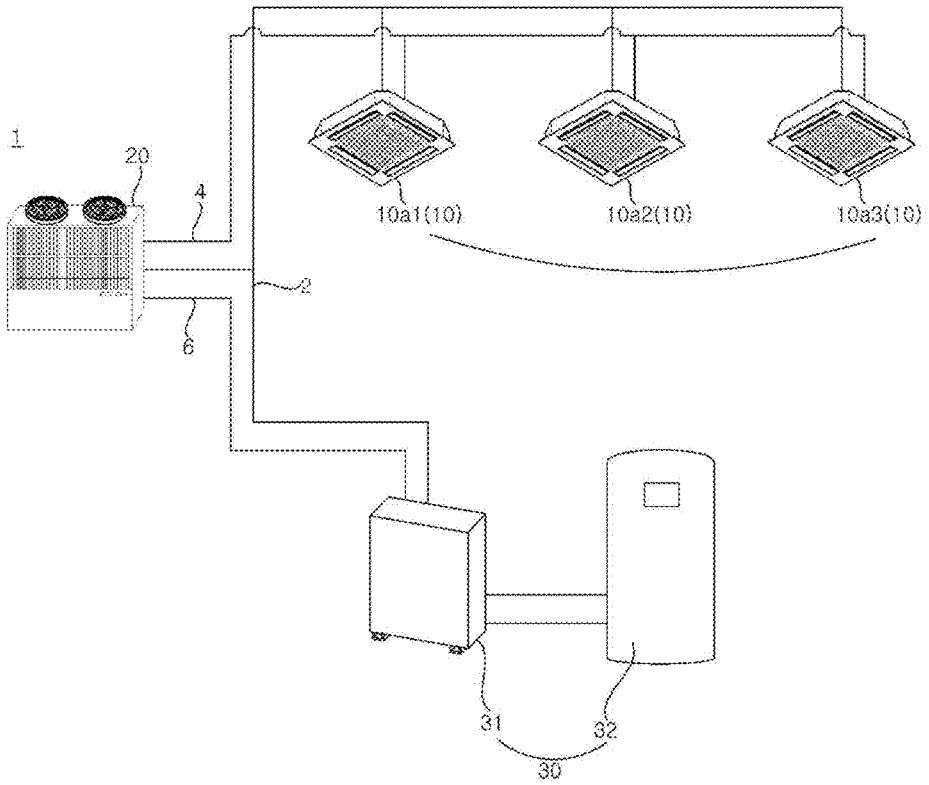

Referring to FIGS. 1A and 1B are system configuration diagrams of an air conditioner according to an embodiment of the present disclosure.

Referring to FIG. 1A, an air conditioner 1 according to an embodiment of the present disclosure includes one or more outdoor units 20 and a plurality of indoor units 10 connected to the outdoor unit 20.

The outdoor unit 20 includes a compressor (see 122 in FIG. 7) and an outdoor heat exchanger (see 124 in FIG. 7) that exchanges heat between a refrigerant flowing through the compressor 122 and external air.

The plurality of indoor units 10 are provided with an indoor heat exchanger (see 112 in FIG. 8), and are connected to the outdoor unit 20 by a plurality of pipes 2, 4, and 6.

Referring to FIG. 1A, the plurality of indoor units 10 includes a first indoor unit group 10*a* and a second indoor unit group 10*b*.

The outdoor unit 20 and the first indoor unit group 10*a* are connected by a first gas pipe 4 and a liquid pipe 6. In addition, the outdoor unit 20 and the second indoor unit group 10*b* are connected by a second gas pipe 6 and the liquid pipe 6. That is, the first and second indoor unit groups 10*a* are connected to the same outdoor unit 20 through dedicated gas pipes 4 and 6, respectively. In addition, the first and second indoor unit groups 10*a* are connected to the same outdoor unit 10 through a common liquid pipe 2. Accordingly, the first and second indoor unit groups 10*a* are connected to the outdoor unit 20 through two pipes.

The plurality of indoor units 10 are divided into two or more groups, and may be controlled for each group. Each group may include one or more indoor units 10. That is, a group may be composed of one indoor unit 10 or a plurality of indoor units 10.

Referring to FIG. 1A, the first indoor unit group 10*a* includes three indoor units 10*a*1, 10*a*2, and 10*a*3, and the second indoor unit group 10*b* includes three indoor units 10*b*1, 10*b*2, and 10*b*3.

Referring to FIG. 1B, any one indoor unit group 10*a* may include three indoor units 10*a*1, 10*a*2, and 10*a*3, and another indoor unit group may include one hot water supply indoor unit 30. The indoor unit 30 for heating/hot water supply may include a water tank 32 that accommodates water, and a hot water supply unit 31 that is provided with an indoor heat exchanger 112 and heats the water in the water tank 32.

The present disclosure is not limited to the examples of FIGS. 1A and 1B. For example, the indoor unit 10 may be divided into three or four groups (more than two), connected to the outdoor unit 20 by each dedicated gas pipe, and controlled as a group. In addition, the number of indoor units 10 included in each group may be variously combined, from 1 to N units, depending on the installation environment.

The air conditioner according to an embodiment of the present disclosure, like a conventional simultaneous cycle, has a structure of total three-pipe, including two gas pipes 4 and 6 and a liquid pipe 1, in the outdoor unit 20 equipped with the outdoor heat exchanger 124, but each gas pipe 4, 6 is connected only to different indoor unit groups 10*a*, 10*b*, so that the indoor unit 20 has a two-pipe structure. That is, based on the indoor unit 10, it is different from the conventional simultaneous cycle in that it is connected to the outdoor unit 20 through two pipes.

In addition, according to an embodiment of the present disclosure, the pressure of the gas pipe 4, 6 is controlled to be changed to high pressure and low pressure, so that the operation of cooling and heating of the indoor unit 10*a*, 10*b* connected to each of the gas pipes 4, 6 may be implemented independently and does not require a distributor connection.

Referring to FIG. 1A, the outdoor unit 20 and the plurality of indoor units 10 are directly connected to the refrigerant pipe 2, 4, 6. A total of three pipes of the outdoor unit 20, which are the first gas pipe 4, the second gas pipe 6, and the liquid pipe 2, are connected to the indoor unit 10 through a service valve.

The indoor unit 10 is divided into groups 10*a* and 10*b* having the same operation mode, and each group 10*a*, 10*b* is connected to the first gas pipe 4 and the second gas pipe 6, and the liquid pipe 2 is commonly connected to all indoor units 10.

All of the indoor units 10*a*1, 10*a*2, and 10*a*3 of the group 10*a* connected to the first gas pipe 4 have the same operation mode, e.g., in a full cooling mode or a full heating mode. All of the indoor units 10*b*1, 10*b*2, and 10*b*3 of the group connected to the second gas pipe 6 have the same operation mode, e.g., in a full cooling mode or a full heating mode.

The independent groups 10*a*, 10*b* connected to the first gas pipe 4 and the second gas pipe 6 are not influenced by each other and have an independent operation mode.

The first gas pipe 4 may freely change its role as a high-pressure gas pipe through which hot gas of high temperature-high pressure discharged from the compressor 122 passes, or a low-pressure gas pipe of superheated low temperature-low pressure from the evaporator, and such a role change may be accomplished by controlling a valve or the like inside the outdoor unit 10.

The second gas pipe 6 may also freely change its role as a high-pressure gas pipe through which hot gas of high temperature-high pressure discharged from the compressor 122 passes, or a low-pressure gas pipe of superheated low temperature-low pressure from the evaporator, and such a role change may be accomplished by controlling a valve or the like inside the outdoor unit 10.

The air conditioner further includes a switching valve (e.g., 126, 128 in FIG. 7) that sends the refrigerant discharged from the compressor 122 to at least one of the outdoor heat exchanger 124 and the indoor heat exchanger 112 disposed inside the plurality of indoor units 10. The outdoor heat exchanger 124 may be switched to a condenser or evaporator through a control of the switching valve 126, 128, and can be operated freely regardless of the indoor unit operation mode.

The refrigerant, which is transferred from the first gas pipe 4 or the second gas pipe 6 to the indoor unit 10 as a high-temperature, high-pressure hot gas and condensed, is transferred to the evaporator through the liquid pipe 2, superheated, and then recovered to the compressor 122 through a low-pressure gas pipe. At this time, the role of the evaporator is the outdoor heat exchanger 124 or the indoor heat exchanger 112 that is operated for cooling.

When the indoor unit group 10*a*, 10*b* is operated for heating and cooling, it is possible to implement high-efficiency heat recovery operation in which most of the condensation and evaporation processes are performed in the indoor heat exchanger 112. At this time, in the outdoor heat exchanger 124 mode, the evaporator and condenser may serve to fill an insufficient part and can be selectively operated.

The first gas pipe 4 may flow a high-temperature and high-pressure refrigerant or a low-temperature and low-pressure refrigerant, depending on the operation mode of the first indoor unit group 10*a*, and the second gas pipe 6 may flow a high-temperature and high-pressure refrigerant or a low-temperature and low-pressure refrigerant, depending on the operation mode of the second indoor unit group 10*b*.

Referring to FIGS. 2A to 2D are diagrams for explaining an outdoor unit piping control according to an embodiment of the present disclosure. There are four piping control methods for the outdoor unit 20, as shown in FIGS. 2A to 2D.

Figure 2A:
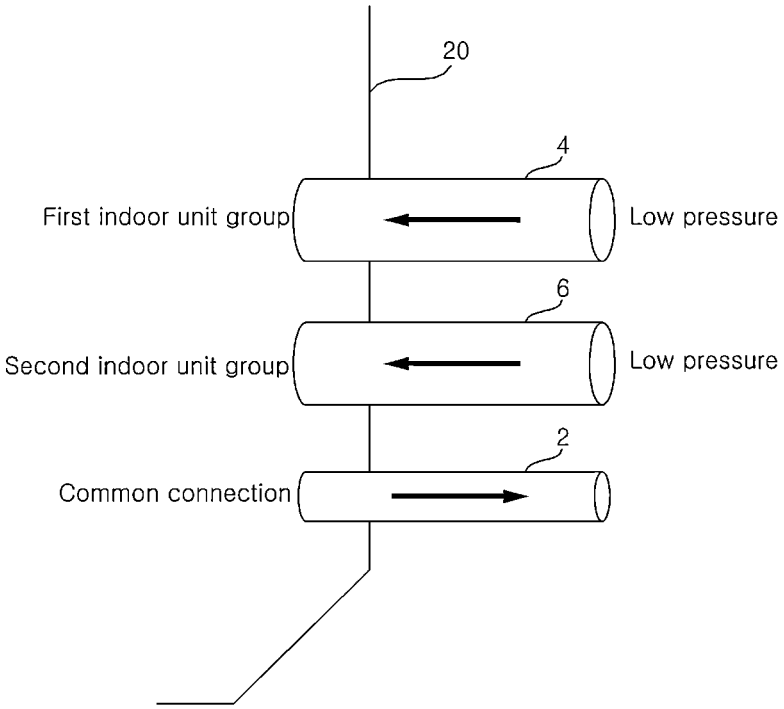
FIGS. 2A to 2D are diagrams for explaining an outdoor unit piping control according to an embodiment of the present disclosure.

FIG. 2A shows a case where the first gas pipe 4 and the second gas pipe 6 are both operated at low pressure by the control of the switching valve 126, 128. The piping control method of FIG. 2A is a piping control method that can be used when both the first indoor unit group 10*a* and the second indoor unit group 10*b* are operated in cooling mode.

Figure 2B:
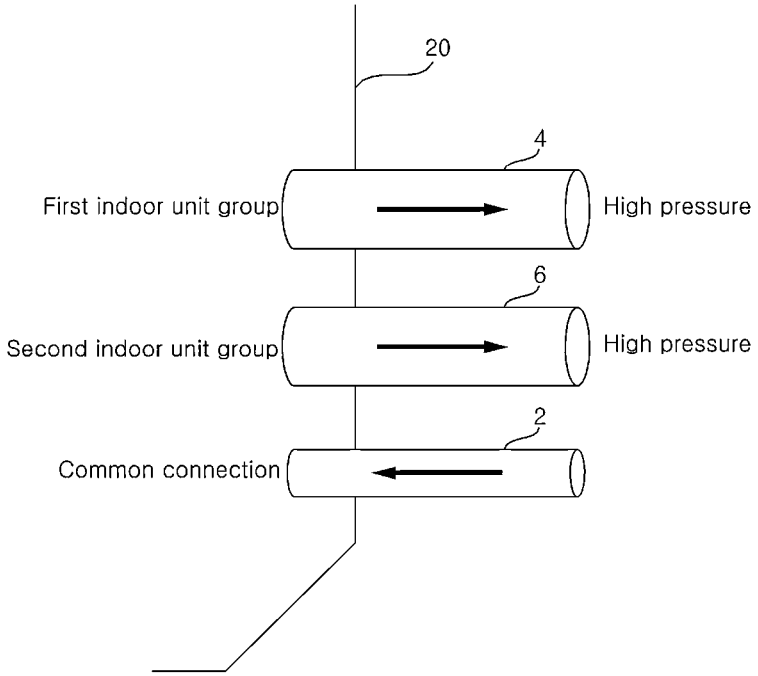

FIG. 2B shows a case where the first gas pipe 4 and the second gas pipe 6 are both operated at high pressure by the switching valve 126, 128. The piping control method of FIG. 2B is a piping control method that can be used when both the first indoor unit group 10*a* and the second indoor unit group 10*b* are operated in heating mode.

Figure 2C:
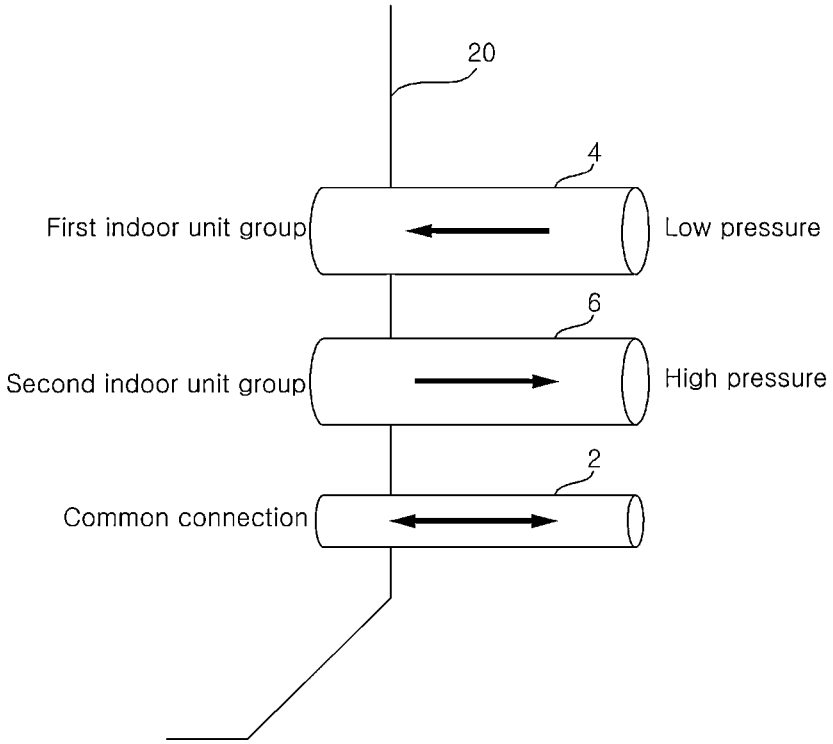

FIG. 2C shows a case where the first gas pipe 4 is operated at low pressure and the second gas pipe 6 is operated at high pressure. The piping control method of FIG. 2C is a piping control method that can be used when the first indoor unit group 10*a* connected to the first gas pipe 4 is operated for cooling and the second indoor unit group 10*b* connected to the second gas pipe 6 is operated for heating.

Figure 2D:
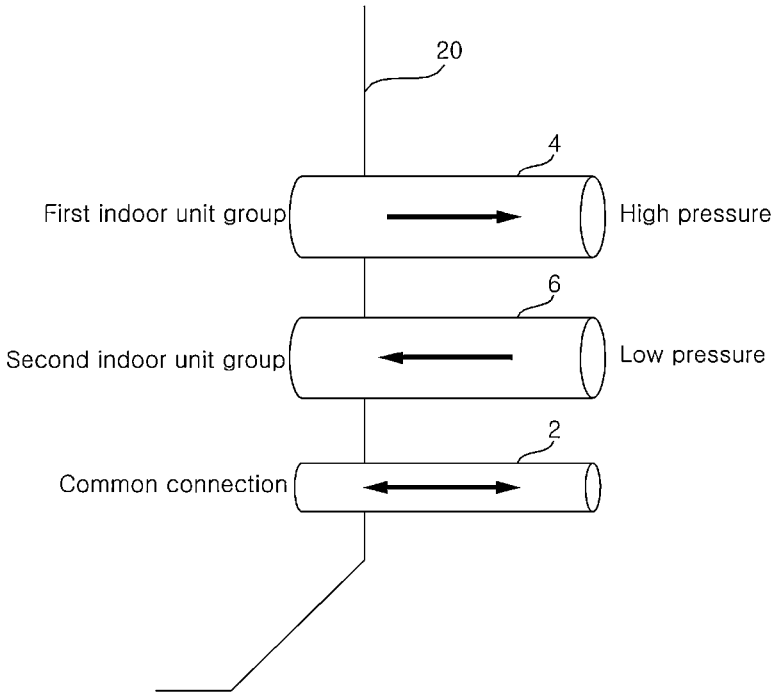

FIG. 2D shows a case where the first gas pipe 4 is operated at high pressure and the second gas pipe 6 is operated at low pressure. The piping control method of FIG. 2D is a piping control method that can be used when the first indoor unit group 10*a* connected to the first gas pipe 4 is operated for heating and the second indoor unit group 10*b* connected to the second gas pipe 6 is operated for cooling.

The indoor units in a group connected to the same gas pipe cannot operate in different modes and can stand by in a stopped state if there is an operation input in a mode different from the operation mode determined as priority.

The low pressure pipe forms a refrigerant flow from the indoor unit 10 side to the outdoor unit 20, the high pressure pipe forms a refrigerant flow from the outdoor unit 20 to the indoor unit 10 side, and the flow direction of the liquid pipe 6 is changed according to the load configuration.

According to an embodiment of the present disclosure, the role of the gas pipe 4, 6 may not be fixed as a high-pressure pipe or low-pressure pipe, but the role may be changed to a high-pressure pipe or low-pressure pipe according to the load of the connected indoor unit group 10*a*, 10*b*. Accordingly, simultaneous operation of heating operation or cooling operation for each group 10*a*, 10*b* is possible without a distributor.

Figure 3A:
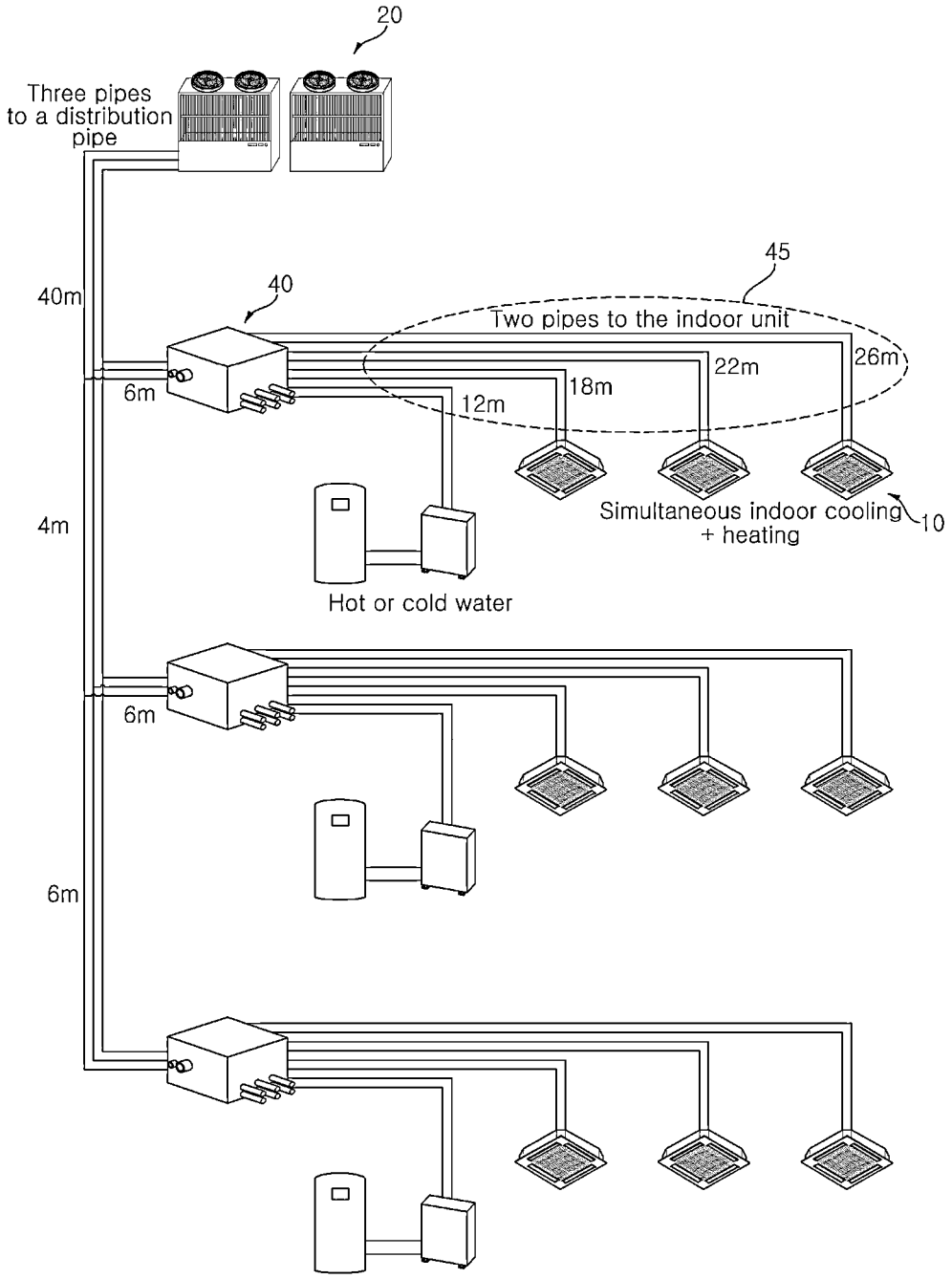
FIG. 3A shows an installation example of a conventional simultaneous air conditioner.
Figure 3B:
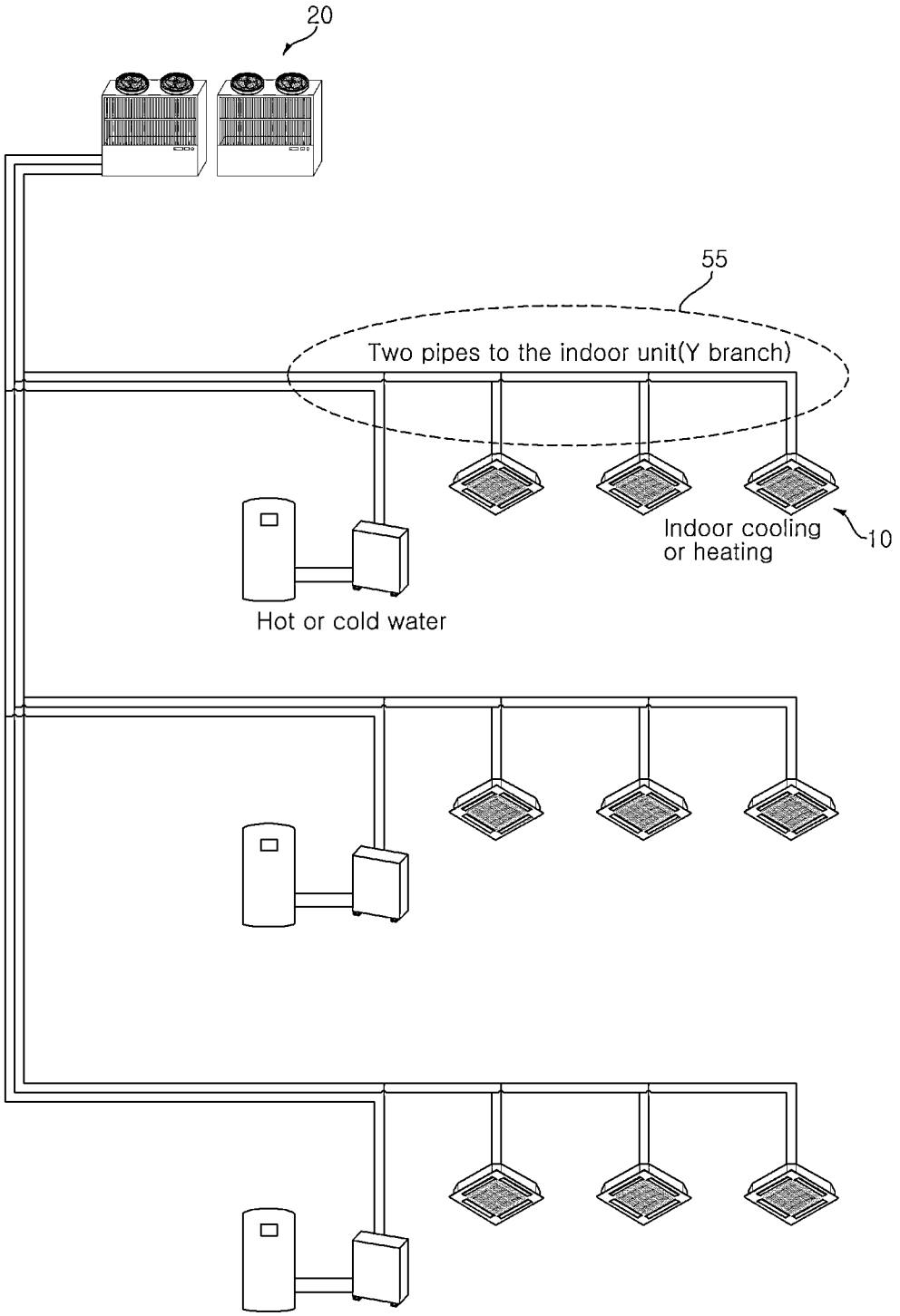
FIG. 3B shows an installation example of a simultaneous air conditioner according to an embodiment of the present disclosure.

FIG. 3A shows an installation example of a conventional simultaneous air conditioner, and FIG. 3B shows an installation example of a simultaneous air conditioner according to an embodiment of the present disclosure.

Referring to FIG. 3A, during simultaneous operation type in which indoor cooling and heating are simultaneously operated, conventionally, a distributor (HR unit 40) to change the high-pressure and low-pressure flow paths must be installed between the outdoor unit 20 and the indoor unit 10.

In the case of the conventional simultaneous operation type using the distributor 40, in a section 45 after the output of the distributor 40, each indoor unit 10 must be connected through two pipes, and the distributor 40 itself has a lot of piping connection points, and is installed indoors. Therefore, there exist a problem such as narrow installation space, operating noise, and valve switching shock.

Referring to FIG. 3B, the indoor unit 10 and the outdoor unit 20 may be connected through a two-pipe Y branch. Since the simultaneous type according to the embodiment of the present disclosure does not require the distributor 40 itself, the installed piping length, including the section 55 before the indoor unit 10, is reduced by half compared to the existing one, an installation space restriction for separate distributor 40 disappear, and valve switching shock and noise disappear.

Figure 4A:
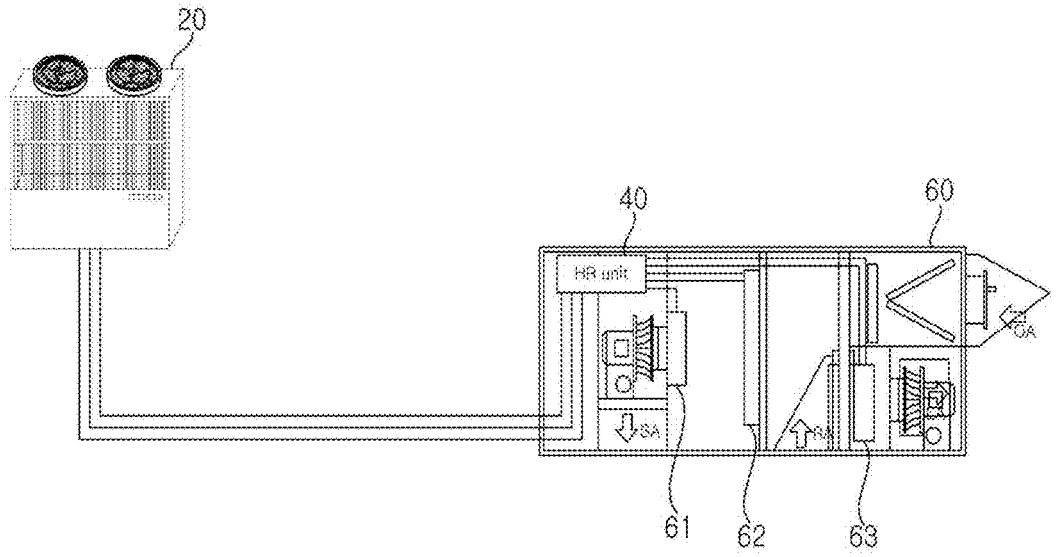
FIG. 4A shows an example of interlocking operation of a dehumidification reheat heat exchanger of a conventional air conditioner.
Figure 4B:
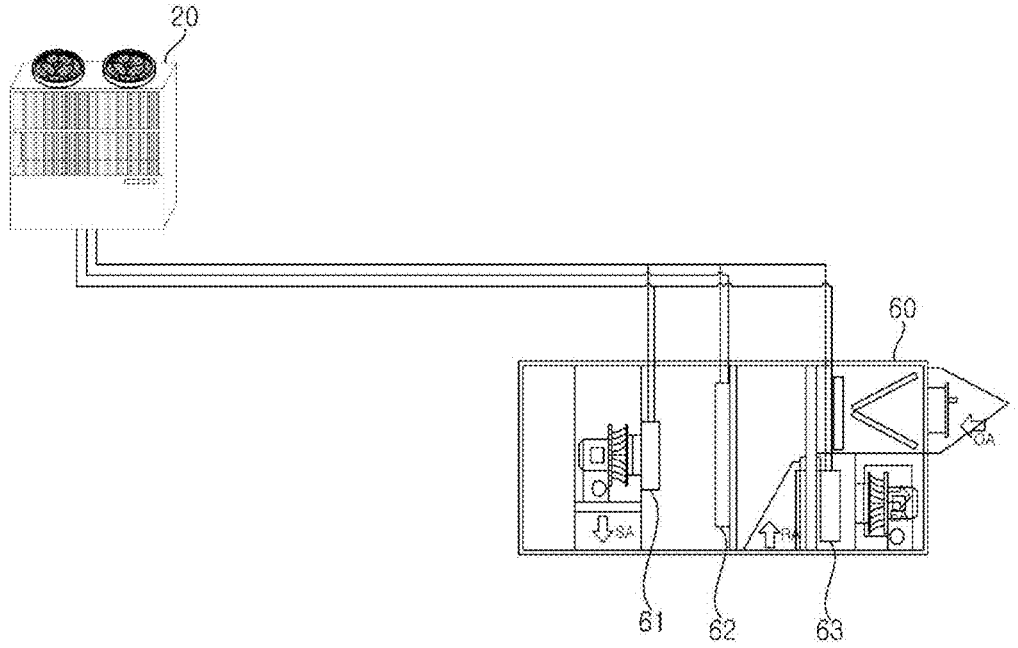
FIG. 4B shows an example of interlocking operation of a dehumidification reheat heat exchanger of an air conditioner according to an embodiment of the present disclosure.

FIG. 4A shows an example of interlocking operation of a dehumidification reheat heat exchanger of a conventional air conditioner, and FIG. 4B shows an example of interlocking operation of a dehumidification reheat heat exchanger of an air conditioner according to an embodiment of the present disclosure.

Referring to FIG. 4A, conventionally, even when the outdoor unit 20 is installed in conjunction with an Air Handling Unit (AHU) 60, etc., it was used by connecting the distributor 40 or by inserting the distributor 40 into the indoor side.

The AHU 60 may be a ventilation device that brings outside air into the room and sends indoor air to the outside of the room. The AHU 60 may be connected to the outdoor unit 20 through a plurality of refrigerant pipes.

In FIG. 4A, the AHU 60 is connected to the outdoor unit 20 through three pipes including a liquid pipe through which liquid refrigerant flows, a high-pressure refrigerant pipe through which high-pressure gaseous refrigerant flows, and a low-pressure refrigerant pipe through which low-pressure gaseous refrigerant flows. The AHU 60 includes a plurality of heat exchangers 61, 62, and 63 that exchange heat of the flowing air with the refrigerant, and a distributor 40 that flows the refrigerant flowing from the outdoor unit 20 to at least one of the plurality of heat exchangers 61, 62, and 63, and sends the refrigerant flowing from at least one of the plurality of heat exchangers 61, 62, and 63 to the outdoor unit 20.

The AHU 60 may be equipped with various heat exchangers 61, 62, and 63.

For example, a plurality of heat exchangers 61, 62, and 63 may include a main heat exchanger that is disposed on a supply flow path to exchange the heat of the refrigerant with the flowing outside air, a recovery heat exchanger that is disposed on the discharge flow path to exchange the heat of the refrigerant with the flowing inside air, and a re-heat exchanger that is disposed on the supply flow path to exchange the heat of the refrigerant with the outside air that passed through the main heat exchanger.

In addition, a plurality of heat exchangers 61, 62, 63 may further include an oxheat exchanger that is disposed on the supply flow path to exchange the heat of the outside air that passed through the re-heat exchanger, a preheat heat exchanger that is disposed on the supply flow path to preheat the air flowing into an outdoor air suction port, etc.

Referring to FIG. 4B, the heat exchanger 61, 62, and 63 may be connected to the outdoor unit 20 through two pipes including a dedicated gas pipe and a common liquid pipe.

According to an embodiment of the present disclosure, through a control that freely switches the pressure of the gas pipe connected from the outdoor unit 20 into high pressure and low pressure, when installed in conjunction with the AHU 60, installation costs and time can be significantly improved by eliminating the insertion of a mechanical part that serves as a distributor 40 or distributor 40.

Meanwhile, separately from the piping control method of FIGS. 2A to 2D, the outdoor heat exchanger 124 can be freely switched between a condenser and an evaporator. The outdoor heat exchanger 124 may be used as a condenser or evaporator, based on the load of the first and second indoor unit groups 10*a* and 10*b*.

If the difference between the evaporation heat amount and the condensation heat amount required according to the load of the first and second indoor unit groups 10*a*, 10*b* is in a heat balance state within a preset standard value, the current mode of the outdoor heat exchanger 124 may be maintained.

In addition, if it is not in a heat balance state as the difference between the evaporation heat amount and the condensation heat amount is large, the current mode of the outdoor heat exchanger 124 can be switched to compensate for the insufficient heat quantity.

According to an embodiment of the present disclosure, when the outdoor unit 20 is provided with a plurality of heat exchangers, and it is not in a heat balance state, if there is a heat exchanger capable of switching a mode to the condenser or the evaporator, it switches the mode of the heat exchanger, and if there is no heat exchanger capable of switching a mode to the condenser or the evaporator, it maintains the current mode of the outdoor heat exchanger.

When an air conditioner according to an embodiment of the present disclosure is provided with a plurality of outdoor units 20*a*, 20*b*, and 20*c*, and it is not in a heat balance state, if there is an outdoor unit capable of switching a mode to the condenser or the evaporator, it switches the outdoor heat exchanger mode of a corresponding outdoor unit, and if there is no heat exchanger capable of switching a mode to the condenser or the evaporator, it maintains the current mode of the outdoor heat exchanger of total outdoor unit 20.

Figure 5:
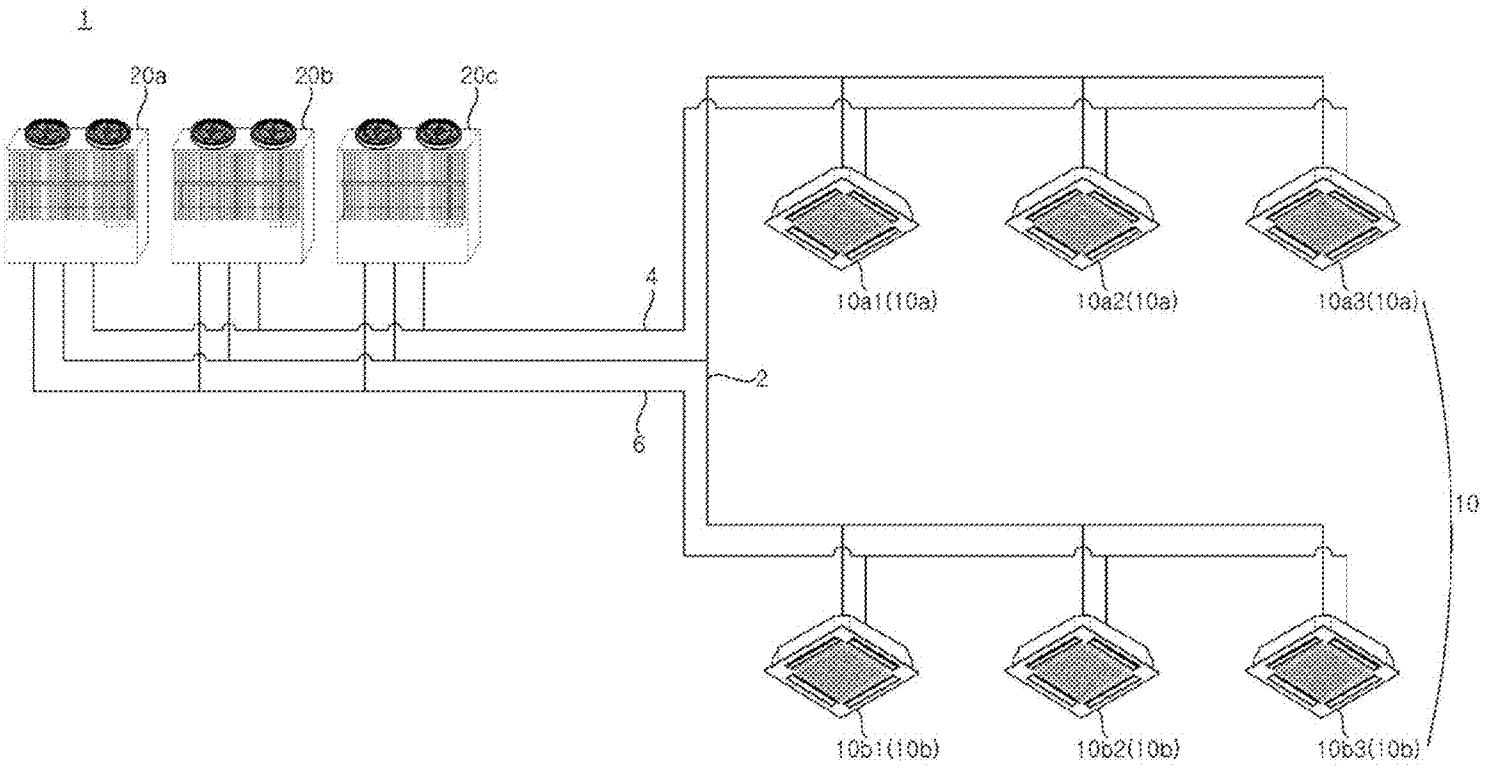
FIG. 5 is a system configuration diagram of an air conditioner according to an embodiment of the present disclosure.

FIG. 5 is a system configuration diagram of an air conditioner according to an embodiment of the present disclosure.

Referring to FIG. 5, a plurality of outdoor units 20*a*, 20*b*, and 20*c* may be connected to the first indoor unit group 10*a* through two pipes (gas pipe 4 and liquid pipe 2), and connected to the second indoor unit group 10*b* through two pipes (gas pipe 6, and liquid pipe 2).

When connecting a plurality of indoor units 10 and one or more outdoor units 20 through a refrigerant pipe, the air conditioner according to an embodiment of the present disclosure divides indoor units that maintain the same operation mode into an indoor unit group 10*a*, 10*b*, and the indoor unit group 10*a*, 10*b* is connected to the outdoor unit 20 through each of the gas pipes 4 and 6 and the common liquid pipe 2. The indoor unit within the same group 10*a*, 10*b* can be connected by minimizing the use of piping by using Y branch, etc.

Each of the gas pipes 4 and 6 operates as a high-pressure pipe or a low-pressure pipe depending on the operation mode of the connected indoor unit group 10*a*, 10*b*.

Figure 6:
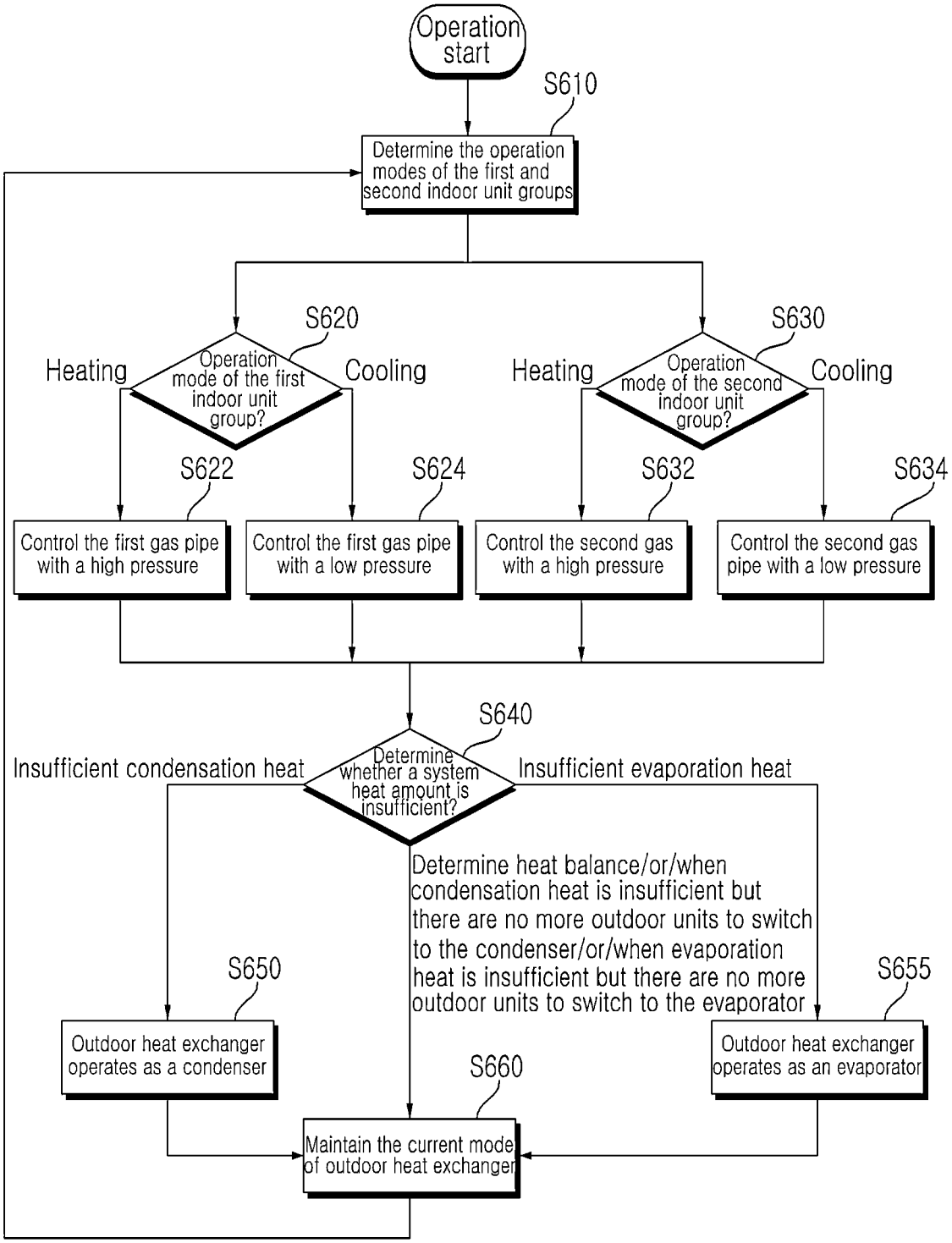
FIG. 6 is a flowchart showing a method of operating an air conditioner according to an embodiment of the present disclosure.

FIG. 6 is a flowchart showing a method of operating an air conditioner according to an embodiment of the present disclosure.

Referring to FIG. 6, the outdoor unit 20 may communicate with the indoor unit 10 to determine the operation modes of the first and second indoor unit groups 10*a* and 10*b* (S610).

The operation modes in the first and second indoor unit groups 10*a* and 10*b* are operated in the same manner. If an operation that violates the main operation mode within the group is input, a corresponding indoor unit stands by in a stopped state. The main operation mode within the first and second indoor unit groups 10*a* and 10*b* can be separately specified in a remote control device, etc. or determined as a mode of indoor unit that is turned on first.

When the operation mode of the first indoor unit group 10*a* is a heating mode (S620), the first gas pipe 4 is controlled inside the outdoor unit as a high pressure pipe (S622). When the operation mode of the first indoor unit group 10*a* is a cooling mode (S620), the first gas pipe 4 is controlled inside the outdoor unit as a low-pressure pipe (S624).

When the operation mode of the second indoor unit group 10*b* is a heating mode (S630), the second gas pipe 6 is controlled inside the outdoor unit as a high-pressure pipe (S632). When the operation mode of the second indoor unit group 10*b* is a cooling mode (S630), the second gas pipe 6 is controlled inside the outdoor unit as a low-pressure pipe (S634).

Meanwhile, the outdoor unit 20 may determine whether a heat amount is balanced and whether a heat amount is insufficient during operation (S640). The outdoor unit 20 may determine the insufficient heat amount during total operation by using cycle data such as indoor temperature, average value of indoor unit piping temperature, system pressure, outdoor temperature, outdoor unit fan RPM, and outdoor unit piping temperature.

If it is determined that the condensation heat amount of the entire system is insufficient, the outdoor unit 20 controls the outdoor heat exchanger 124 as a condenser (S650). In addition, if it is determined that the evaporation heat amount of the entire system is insufficient, the outdoor unit 20 controls the outdoor heat exchanger 124 as an evaporator (S655).

When a plurality of outdoor units 20 (20*a*, 20*b*, 20*c*) are provided, the operation mode of the plurality of outdoor units (20*a*, 20*b*, 20*c*) may be sequentially changed one by one.

Meanwhile, even if it is determined that the evaporation heat amount of the entire system is insufficient, when the current outdoor unit can no longer be changed to an evaporator, the current mode is maintained (S660). In addition, if it is determined that the condensation heat amount of the entire system is insufficient, but the current outdoor unit cannot be changed to a condenser, the current mode is maintained (S660).

Figure 7:
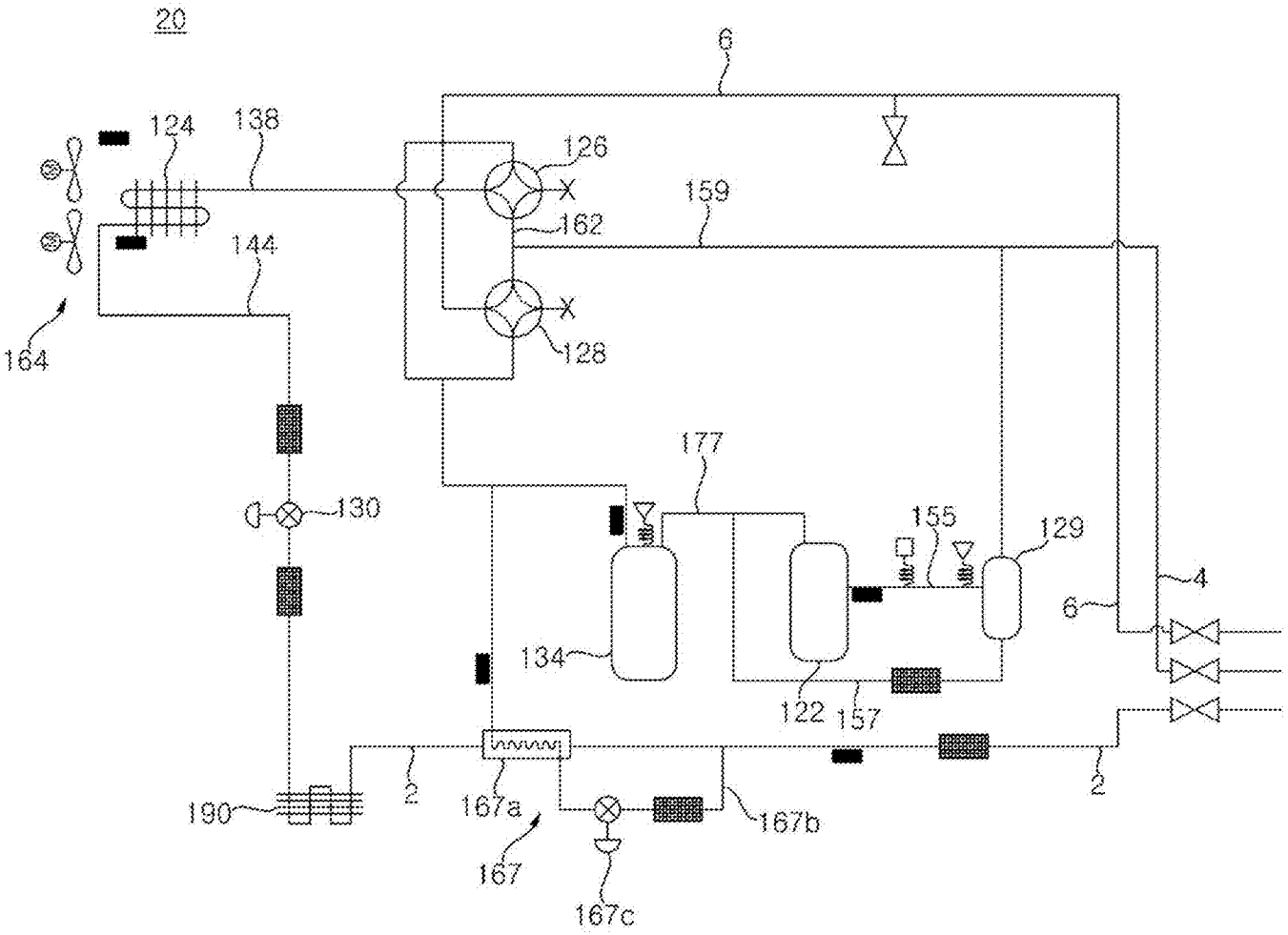
FIG. 7 is a cycle configuration diagram of an outdoor unit of an air conditioner according to an embodiment of the present disclosure.
Figure 8:
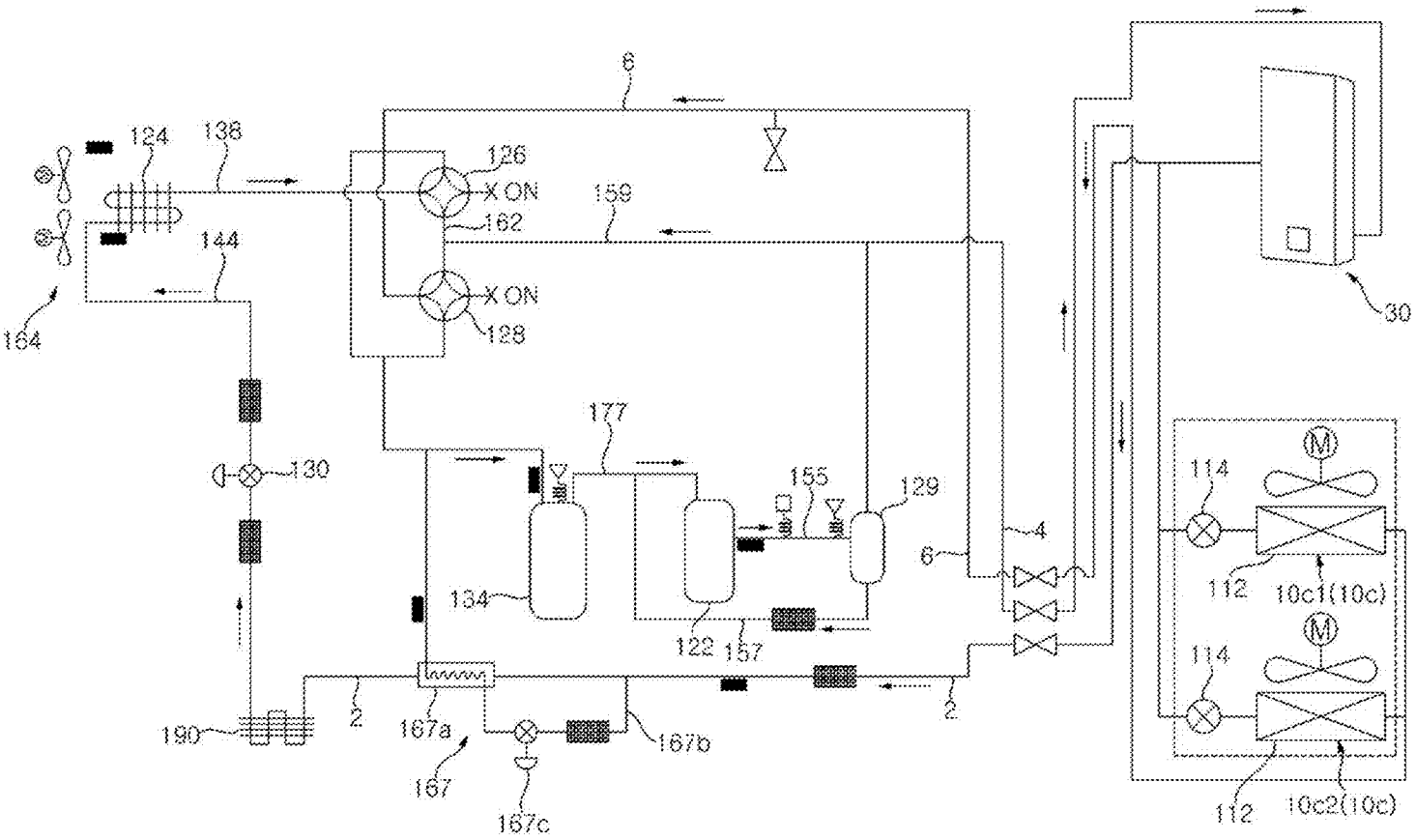
FIGS. 8 to 10 are diagrams for explaining the operation of the air conditioner of FIG. 7.
Figure 9:
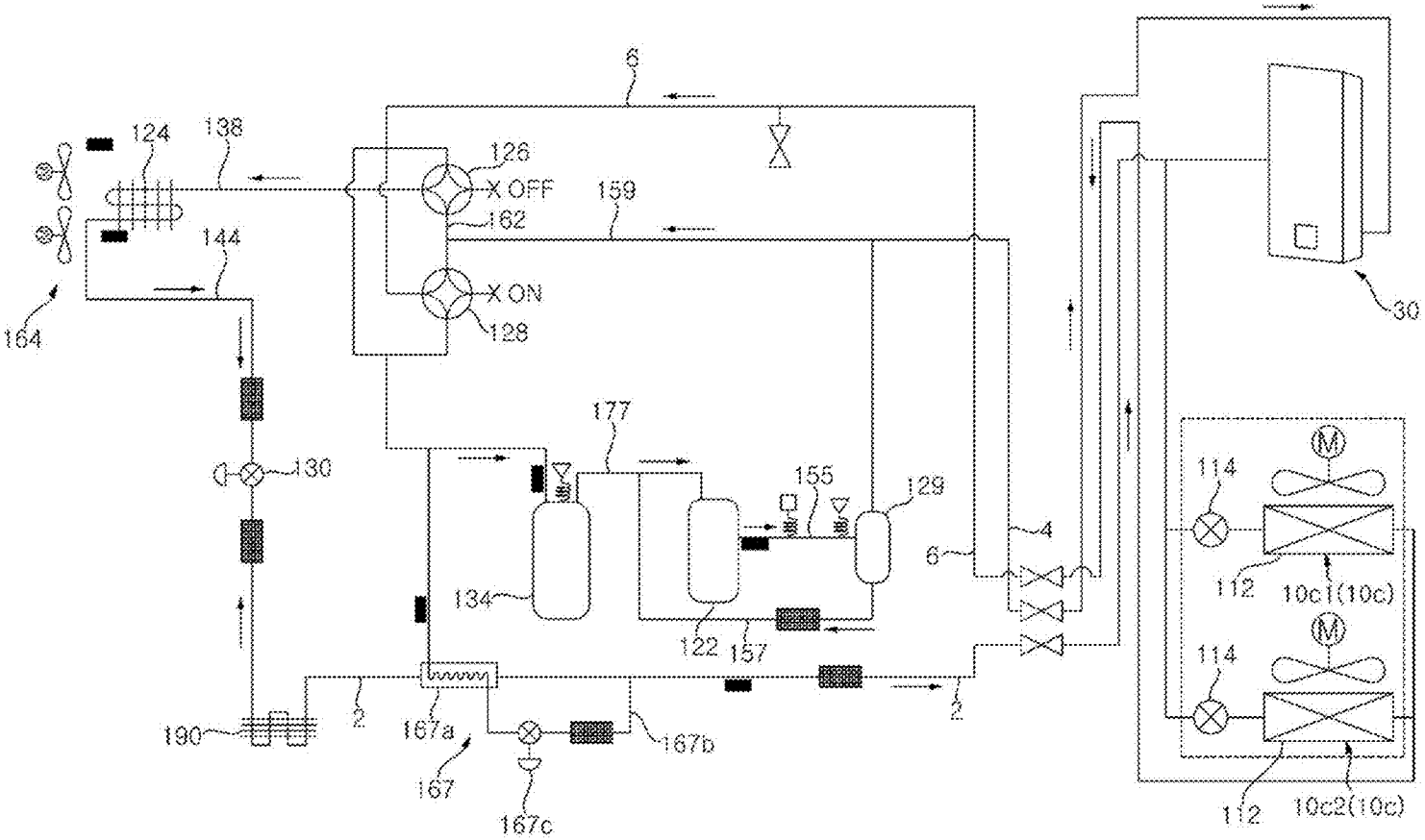
Figure 10:
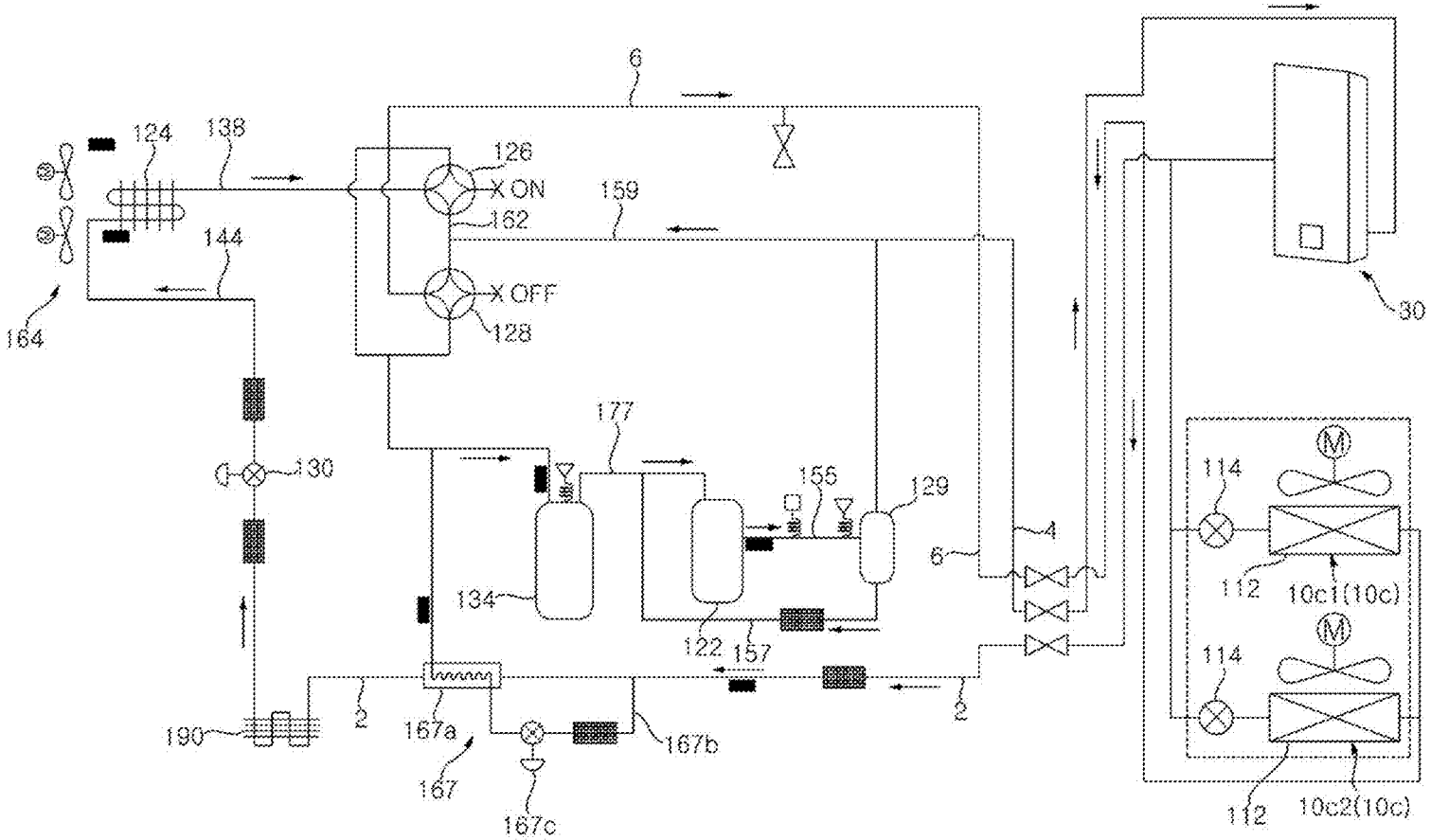

FIG. 7 is a cycle configuration diagram of an outdoor unit of an air conditioner according to an embodiment of the present disclosure. Referring to FIGS. 8 to 10 are diagrams for explaining the operation of the air conditioner in FIG. 7, and diagrams showing the operation for each situation when the first indoor unit group 10*a* connected to the outdoor unit 20 through the first gas pipe 4 is a dedicated heating indoor unit 30.

According to an embodiment of the present disclosure, a certain indoor unit group may be composed of a dedicated heating indoor unit or a dedicated cooling indoor unit.

Referring to FIG. 8, the first indoor unit group 10*a* connected to the outdoor unit 20 through the first gas pipe 4 is composed of a dedicated heating indoor unit 30, and the first gas pipe 4 may flow high-temperature and high-pressure refrigerant depending on whether the first indoor unit group 10*a* is operated (on/off). For example, the dedicated heating indoor unit 30 may be a hot water heater that performs a hot water supply operation.

Referring to FIG. 8, the second indoor unit group 10*c* connected to the outdoor unit 20 through the second gas pipe 6 may be composed of an indoor unit 10*c*1, 10*c*2 for both heating and cooling. The second gas pipe 6 may flow high-temperature and high-pressure refrigerant or low-temperature and low-pressure refrigerant, depending on the operation mode of the second indoor unit group 10*c*.

That is, the second gas pipe 6 can be switched and used as a high-pressure pipe or a low-pressure pipe, and the first gas pipe 4 can be used as a high-pressure pipe.

Referring to FIGS. 7 and 8, the outdoor unit 20 may include a first switching valve 126 that switches the outdoor heat exchanger 124 into a condenser or an evaporator, and a second switching valve 128 that switches the second gas pipe 6 into a high-pressure pipe or low-pressure pipe. The first switching valve 126 and the second switching valve 128 may be a four-way valve.

When the first indoor unit group 10*a* performs a heating operation and the second indoor unit group 10*c* performs a cooling operation, if the heating load is greater, the first switching valve 126 is turned on, so that the outdoor heat exchanger 124 may be used as an evaporator. When the first indoor unit group 10*a* is turned off and the second indoor unit group 10*c* is in operation, the first switching valve 126 is turned off, so that the outdoor heat exchanger 124 may be used as a condenser.

When the first indoor unit group 10*a* performs a heating operation and the second indoor unit group 10*c* performs a cooling operation, if the cooling load is larger, the first switching valve 126 is turned off, so that the outdoor heat exchanger 124 can be used as a condenser. When the second indoor unit group 10c is turned off, if first indoor unit group 10*a* is operating, the first switching valve 126 is turned on, and the outdoor heat exchanger 124 can be used as an evaporator.

When the first and second indoor unit groups 10a and 10c perform a heating operation, the first switching valve 126 is turned on, and the outdoor heat exchanger 124 is used as an evaporator. In addition, the first and second indoor unit groups 10*a* and 10*c* may be freely turned on or off without switching the first switching valve while the indoor unit of other group is operating.

Meanwhile, if the difference between the evaporation heat amount and the condensation heat amount required according to the load of the first and second indoor unit groups 10*a* and 10*c* is in a heat balance state within a preset standard value, the current mode of the first switching valve 126 may be maintained.

A conventional heat pump technology that simultaneously implements a heating such as hot water supply and a cooling is implemented by a case where an outdoor unit for heating and an outdoor unit for cooling are provided separately, a case where a heat recovery operation is performed by installing the HR distributor 40 in a middle, or a case where it is implemented by a single outdoor unit, and cooling is stopped while hot water heating is operating.

However, according to the embodiment of the present disclosure, by controlling the second gas pipe 6 to be switched to a high pressure pipe or a low pressure pipe according to each situation, a high-efficiency heat recovery operation is possible without an HR distribution structure while simultaneously implementing a hot water heating operation and a cooling operation by using a single outdoor unit 20.

FIG. 8 shows a case in which a heating/hot water supply operation and a cooling air conditioning operation are performed, and illustrates a case in which the heating load is larger.

Referring to FIG. 8, the indoor unit 30 for heating/hot water supply is operated by being connected to two pipes including the first gas pipe 4 and the liquid pipe 6. In addition, the indoor unit 10*c* for cooling operation is operated by being connected to two pipes including the second gas pipe 6 and the liquid pipe 6.

The first switching valve 126 is turned on when it is determined that the heating load is greater as a result of indoor load analysis, and the outdoor heat exchanger 124 is operated as a low-pressure evaporator.

The indoor unit 10*c* for cooling operation may be freely turned on/off while the indoor unit 30 for heating/hot water supply is operating.

When the indoor unit 30 for heating/hot water supply is turned off, the first switching valve 126 needs to be switched depending on whether the indoor unit 10*c* for cooling operation is in operation. When the indoor unit 10*c* for cooling operation is in operation, the first switching valve 126 is switched from an ON state to an OFF state, and the outdoor heat exchanger 124 is switched to a condenser. If the indoor unit 10*c* for cooling operation is in an OFF state, the entire air conditioner system may be directly turned OFF.

FIG. 9 shows a case where a heating/hot water supply operation and a cooling air conditioning operation are performed, and illustrates a case in which the cooling load is larger.

Referring to FIG. 9, the indoor unit 30 for heating/hot water supply is operated by being connected to two pipes including the first gas pipe 4 and the liquid pipe 6. In addition, the indoor unit 10*c* for cooling operation is operated by being connected to two pipes including the second gas pipe 6 and the liquid pipe 6.

The first switching valve 126 is turned off when it is determined that the cooling load is greater as a result of indoor load analysis, and the outdoor heat exchanger 124 is operated as a high-pressure condenser.

The indoor unit 30 for heating/hot water supply can be freely turned on/off while the indoor unit 10*c* for cooling operation is in operation.

When the indoor unit 10*c* for cooling operation is turned off, the first switching valve 126 needs to be switched depending on whether the indoor unit 30 for heating/hot water supply is in operation. When the indoor unit 30 for heating/hot water supply is in operation, the first switching valve 126 is switched from an OFF state to an ON state, and the outdoor heat exchanger 124 is switched to an evaporator. If the indoor unit 30 for heating/hot water supply is in the OFF state, the entire air conditioner system may be directly turned OFF.

FIG. 10 shows a case where a heating/hot water supply operation and a heating air conditioning operation are performed.

Referring to FIG. 10, the indoor unit 30 for heating/hot water supply is operated by being connected to two pipes including the first gas pipe 4 and the liquid pipe 6. In addition, the indoor unit 10*c* for heating operation is operated by being connected to two pipes including the second gas pipe 6 and the liquid pipe 6.

Since the indoor load is the entire heating load, the first switching valve 126 is turned on and the outdoor heat exchanger 124 is operated as a low-pressure evaporator.

The indoor unit 10*c* for heating operation can be freely turned on/off while the indoor unit 30 for heating/hot water supply is operating. In addition, the indoor unit 30 for heating/hot water supply can be freely turned on/off while the indoor unit 10*c* for heating operation is in operation.

In the above, the main configuration of the present disclosure was described with reference to FIGS. 7 to 10. Hereinafter, the remaining configuration of the outdoor unit cycle will be described in detail, but embodiment of the present disclosure is not limited thereto. For example, a plurality of compressors 122, heat exchangers 124, etc. may be provided, and accordingly, the flow path and valve configuration may vary.

Referring to FIGS. 7 to 10, the liquid pipe 2 is branched and connected to each of the plurality of indoor units 30 and 10*c*. The second gas pipe 6 is branched and connected to each of the indoor units 10*c*1 and 10*c*2 of the second indoor unit group 10*c*. The first gas pipe 4 is connected to the indoor unit of the first indoor unit group 10*a*.

Referring to FIGS. 7 to 10, one indoor unit 30 for heating/hot water supply is illustrated as an indoor unit of the first indoor unit group 10*a*.

Referring to FIG. 1A, and the like, the second indoor unit group 10*b* includes a plurality of indoor units 10*b*1, 10*b*2, and 10*b*3 for both heating and cooling.

In this case, the second gas pipe 6 is branched and connected to each of the indoor units 10*b*1, 10*b*2, and 10*b*3 of the second indoor unit group 10*b*.

A gas pipe valve 114 may be disposed in the gas pipes 2 and 4 connected to the indoor unit 10. For example, the gas pipe valve 114 may be disposed in each of the plurality of second gas pipes 6 that are branched. The gas pipe valve 114 can also be disposed inside each indoor unit 10.

The outdoor unit 20 includes a compressor 122 that compresses the refrigerant and an outdoor heat exchanger 124 that exchanges heat of the refrigerant with the outdoor air. The outdoor unit 20 includes a switching valve 126, 128 that transmits the refrigerant discharged from the compressor 122 to at least one of the outdoor heat exchanger 124 and the indoor heat exchanger 112 disposed inside the plurality of indoor units 10. The outdoor unit 20 may include an expansion valve 130 that expands the refrigerant flowing to or from the outdoor heat exchanger 124.

The liquid pipe 2 may be connected to the outdoor heat exchanger 124, and the expansion valve 130 may be disposed in the outdoor heat exchanger 124 side in the liquid pipe 2. In addition, the liquid pipe 2 and the outdoor heat exchanger 124 may be connected through a sub-liquid pipe 144, and the expansion valve 130 may be disposed in the sub liquid pipe 144.

An outdoor heat exchanger connection pipe 138 connecting the first switching valve 126 and the outdoor heat exchanger 124 may be disposed in the outdoor unit 20.

The outdoor unit 20 may include an oil separator 129 that recovers oil in the refrigerant discharged from the compressor 122. The oil separated in the oil separator 129 can be recovered to the compressor 122 through an oil recovery flow path 157.

The compressor 122 or the oil separator 129 may be connected to a first connection flow path 159. The first connection flow path 159 may be connected to a second connection flow path 162. The second connection flow path 162 may connect the first switching valve 126 and the second switching valve 128.

The outdoor unit 20 may include an accumulator 134 that separates the refrigerant flowing into the compressor 122 into gaseous refrigerant and liquid refrigerant and sends only the liquid refrigerant to the compressor 122.

A suction flow path 177 may guide the gaseous refrigerant from the accumulator 134 to the compressor 122. The gaseous refrigerant may be discharged from the accumulator 134 to the suction flow path 177 and may be sucked into the compressor 122.

The compressor 122 may be connected to accumulator 134. The refrigerant suction flow path of the compressor 122 may be in communication with the accumulator 134. The compressor 122 may discharge refrigerant to a discharge flow path 155.

The first switching valve 126 may be connected to the outdoor heat exchanger connector 138 and the first gas pipe 4. The second switching valve 128 may be connected to the second gas pipe 6 and the first gas pipe 4.

The outdoor unit 20 may include an outdoor fan 164. The outdoor fan 164 may be disposed to face the outdoor heat exchanger 126. The outdoor fan 164 may serve to blow outside air to the outdoor heat exchanger 126.

The outdoor unit 20 may include a supercooler 167 that supercools a portion of the refrigerant flowing through the liquid pipe 2 and sends it to the compressor 122 or the accumulator 134. The supercooler 167 may be connected to the liquid pipe 2, and the liquid pipe 2 may extend to the outside of the outdoor unit 20. The supercooler 167 may serve to supercool the refrigerant that passed through the outdoor heat exchanger 126 during operation of the cooling entire room or simultaneous operation of the cooling main body.

The supercooler 167 may include a supercooling heat exchanger 167*a*, a bypass flow path 167*b*, and a supercooling expansion mechanism 167*c*. The bypass flow path 167*b* may connect the liquid pipe 2 and the supercooling heat exchanger 167*a*. During the cooling entire room or the simultaneous operation of the cooling main body, the bypass flow path 167*b* may guide a portion of the refrigerant flowing along the liquid pipe 2 into the supercooling heat exchanger 167*a*. The supercooling expansion mechanism 167*c* may be installed in the bypass flow path 167*b*. The supercooling expansion mechanism 167*c* may be an electronic expansion valve (EEV). During the cooling entire room or the simultaneous operation of the cooling main body, the refrigerant flowing into the bypass flow path 167*b* passes through the supercooling expansion mechanism 167*c*, expands, and may be guided into the supercooling heat exchanger 167*a*.

A plurality of temperature sensors may be disposed in the outdoor unit 20. For example, the outdoor heat exchanger temperature sensor may measure the temperature of the outdoor heat exchanger 124. In addition, the outdoor heat exchanger temperature sensor may be disposed in the outlet side of the outdoor heat exchanger 124 and may measure the temperature of the refrigerant condensed in the outdoor heat exchanger 124.

The outdoor unit 20 may further include a heat sink 190 connected to the liquid pipe 2. The heat sink 190 may be connected to an inverter circuit board (not shown) that drives the compressor 122 to cool an inverter circuit board.

As described with reference to FIGS. 8 to 10, the refrigerant flow is controlled according to the operation of the first switching valve 126 and the second switching valve 128. The first switching valve 126 may switch the outdoor heat exchanger 124 into a condenser or an evaporator, and the second switching valve 128 may switch the second gas pipe 6 into a high pressure pipe or a low pressure pipe.

According to an embodiment of the present disclosure, the outdoor unit 20 is connected to two gas pipes 4 and 6 and one liquid pipe 2, the first gas pipe 4 is connected to an indoor unit (hot water, hot water supply) that always requires heating in all four seasons, and the second gas pipe 6 is connected to an indoor unit (air conditioning) that can select between cooling and heating.

The first switching valve 126 and the second switching valve 128 may be a four-way valve, the operation of the first switching valve 126 may determine the operation mode of the outdoor heat exchanger 124, and the operation of the second switching valve 128 may convert the operation mode of the second gas pipe 6 into a high pressure or low pressure. At this time, the first gas pipe 4 is directly connected from the high-temperature and high-pressure gas pipe discharged from the compressor 122 and always serves to discharge high-temperature and high-pressure gas refrigerant.

The first and second gas pipes 4, 6 can be connected to the indoor unit within the same group, and indoor units connected to the same gas pipe are always operated in the same operation mode. The liquid pipe 2 may be commonly used and has two cases including a case of connecting to the first gas pipe 4 and a case of connecting to the second gas pipe 6, and each indoor unit 10 may be connected by two pipes (gas pipe (first pipe 4 or second pipe 5), liquid pipe).

The first switching valve 126 determines whether to operate the outdoor heat exchanger 124 of the outdoor unit 20 as a condenser (high pressure) or as an evaporator (low pressure). The mode of the outdoor heat exchanger 124 may be decided by determining the total indoor load and determining whether the evaporator or condenser is insufficient.

The second switching valve 128 is switched depending on whether the second gas pipe 6 is to be operated as a high-pressure pipe or a low-pressure pipe, and the operation mode moves according to the user's handling of the indoor unit connected to the second gas pipe 6.

A total of three high-pressure or low-pressure operation cases of each indoor unit 10 and outdoor heat exchanger 124 can be implemented (see FIGS. 8 to 10).

Figure 11A:
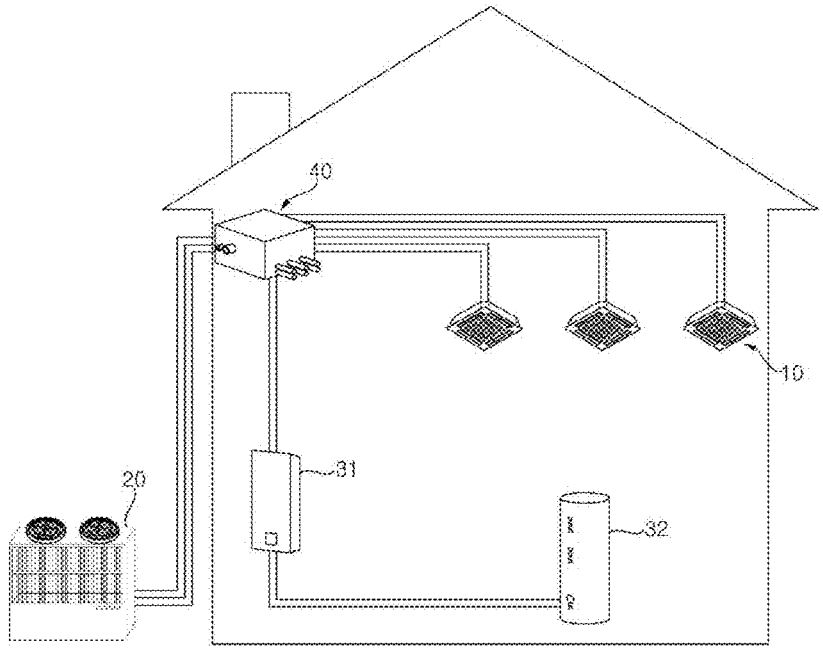
FIG. 11A shows an installation example of hot water supply and heating/cooling air conditioning of a conventional air conditioner.
Figure 11B:
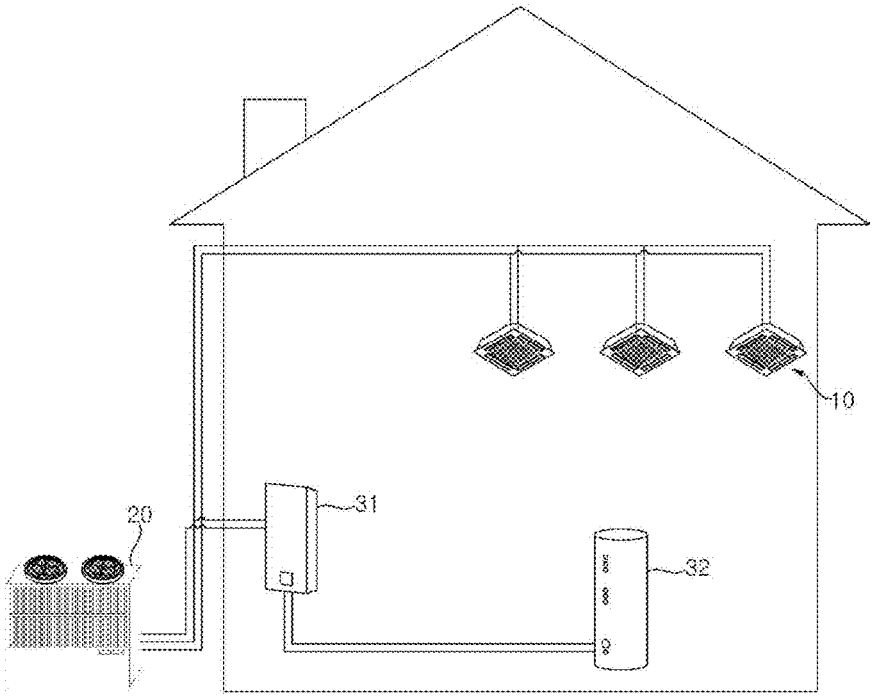
FIG. 11B shows an installation example of a simultaneous air conditioner according to an embodiment of the present disclosure.

FIG. 11A shows an installation example of hot water supply and heating/cooling air conditioning of a conventional air conditioner, and FIG. 11B shows an installation example of a simultaneous air conditioner according to an embodiment of the present disclosure.

FIG. 11A shows an example in which the outdoor unit 20, the indoor unit 10 for air conditioning, and the hot water heater 31, 32 are connected and installed in a house through the distributor (HR unit) 40. Since the distributor 40 controls the distribution of the flow of refrigerant, high-efficiency heat recovery operation is possible. However, since the outdoor unit's 3 pipes and the indoor unit's 2 pipes are connected to the distributor 40 respectively, there is a problem in that the installation of the refrigerant pipe becomes complicated, and it is difficult to install in a narrow space or makes a space even narrower.

Referring to FIG. 11B, the simultaneous air conditioner according to an embodiment of the present disclosure can simultaneously operate with high efficiency heat recovery while it can be easily installed by connecting two pipes Y branch between the outdoor unit 20, the indoor air conditioning unit 10, and the hot water heater 31, 32, without distributor 40.

According to an embodiment of the present disclosure, a plurality of indoor units 10 connected to one outdoor unit 20 are divided into first and second indoor unit groups 10*a* and 10*b*, and the second indoor unit group 10*b* can freely operate cooling and heating while the first indoor unit group 10*a* maintains heating operation, so that it is not necessary to install a distributor 40.

In addition, it is possible to achieve a highly efficient heat recovery operation in which the refrigerant gas condensed after heating the first indoor unit group 10*a* flows into the evaporator of the second indoor unit group 10*b* through the liquid pipe 2.

Figure 12:
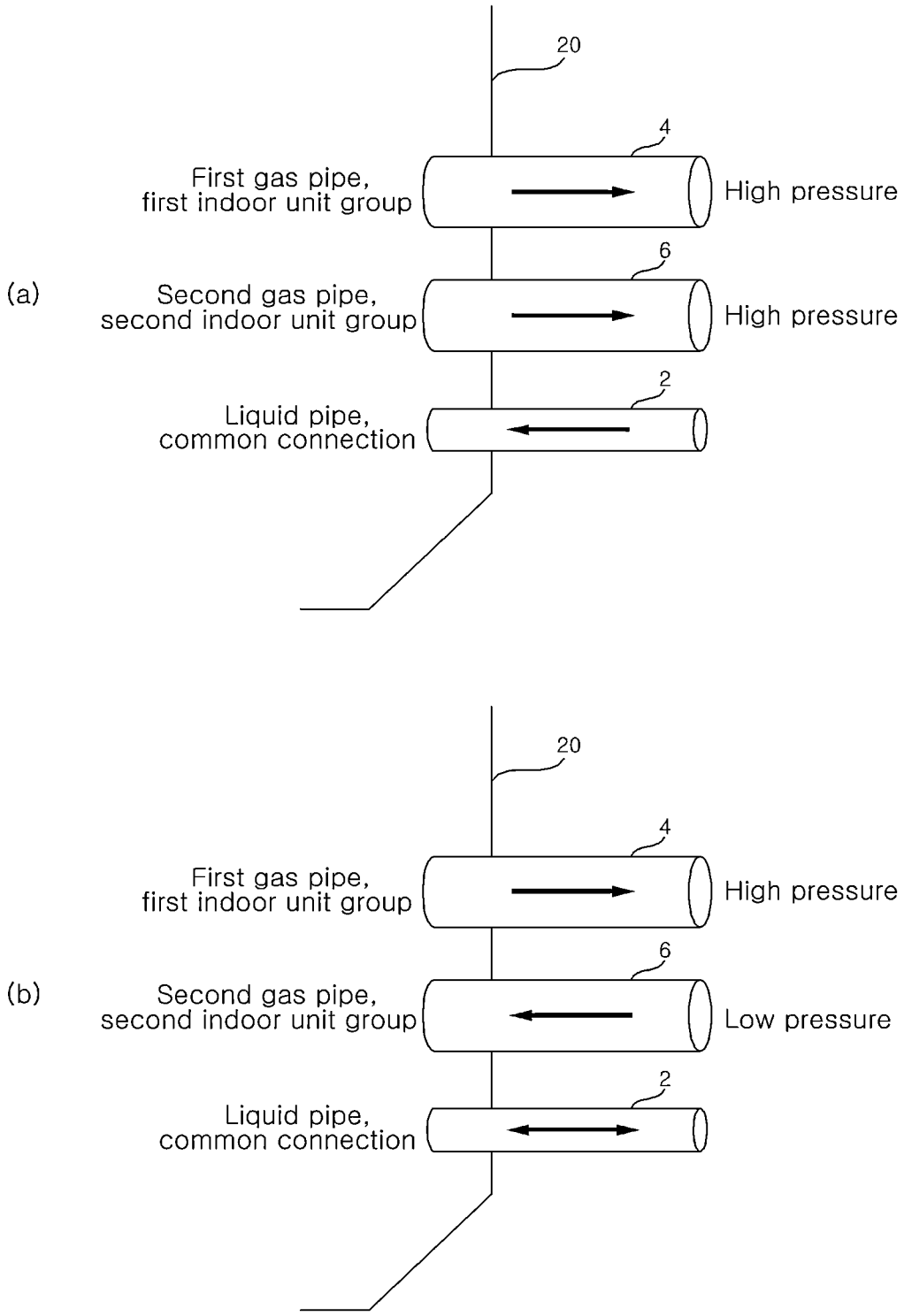
FIGS. 12(*a*) and (*b*) are diagrams for explaining an outdoor unit piping control according to an embodiment of the present disclosure.

FIG. 12 is a diagram for explaining an outdoor unit piping control according to an embodiment of the present disclosure.

FIG. 12A shows a case where the first gas pipe 4 and the second gas pipe 6 are both operated at high pressure by controlling the internal switching valve 126, 128. The piping control method of FIG. 12A is a piping control method that can be used when both the first indoor unit group 10*a* and the second indoor unit group 10*b* are operated for heating.

FIG. 12B shows a case where the first gas pipe 4 is operated at high pressure and the second gas pipe 6 is operated at low pressure. The piping control method of FIG. 12B is a piping control method that can be used when the first indoor unit group 10*a* connected to the first gas pipe 4 is operated for heating and the second indoor unit group 10*b* connected to the second gas pipe 6 is operated for cooling.

The indoor units in a group connected to the same gas pipe cannot operate in different modes and are determined by priority. If there is an operation input in a mode different from the operation mode, it stops and stands by.

The refrigerant flows from the indoor side to the outdoor unit in the low-pressure pipe, the refrigerant flows from the outdoor unit to the indoor side in the high-pressure pipe, and the flow direction of the liquid pipe changes depending on the load configuration.

Figure 13:
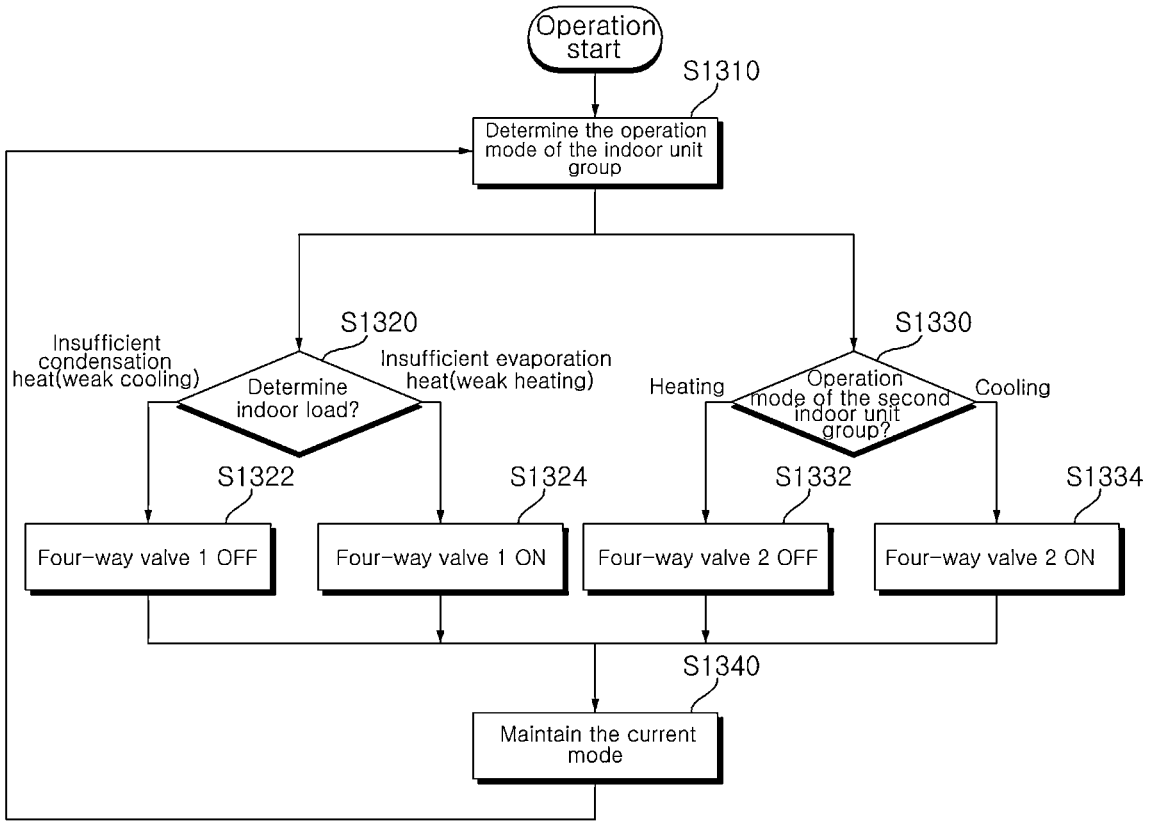
FIG. 13 is a flowchart showing a method of operating an air conditioner according to an embodiment of the present disclosure.

FIG. 13 is a flowchart showing a method of operating an air conditioner according to an embodiment of the present disclosure.

Referring to FIG. 13, the outdoor unit 20 can communicate with the indoor unit 10 to determine the operation modes of the first and second indoor unit groups 10*a* and 10*b* (S1310).

The operation modes in the first and second indoor unit groups 10*a* and 10*b* are operated in the same manner. If an operation that violates the main operation mode within the group is input, a corresponding indoor unit stands by in a stopped state. The first indoor unit group 10*a* is capable of operating only heating and controlling only the turn-on/off of heating operation. The main operation mode in the second indoor unit group 10*b* may be specified separately by a remote control device, etc. or decided as the mode of the indoor unit that is turned on first. The first indoor unit group 10*a* connected to the first gas pipe 4 maintains the heating mode, and the second indoor unit group 10*b* connected to the second gas pipe 6 operates while performing a switching between cooling and heating operations according to user operation.

The outdoor unit 10 may determine the heat amount of the entire system and determine whether there is a lack of evaporation heat amount or a lack of condensation heat amount (S1320).

If it is determined that the condensation heat amount is insufficient, when the current mode of the first switching valve 126 is in an ON-state (evaporator), it can be operated while switching to an OFF-state (condenser) (S1322).

If it is determined that the evaporation heat amount is insufficient, when the current mode of the first switching valve 126 is in an OFF-state (condenser), it can be operated while switching to an ON-state (evaporator) (S1324).

Meanwhile, when the operation mode of the second indoor unit group 10*b* is heating (S1330), the second gas pipe 6 is controlled as a high pressure pipe inside the outdoor unit (S1332). When the operation mode of the second indoor unit group 10*b* is cooling (S1330), the second gas pipe 6 is controlled as a low-pressure pipe inside the outdoor unit (S1334).

Thereafter, the outdoor unit 20 may monitor the operation mode (S1310) and indoor load (S1320) of the first and second indoor unit groups, and operate in response to its change, while maintaining the current mode (S1340).

According to at least one of the embodiments of the present disclosure, a simultaneous operation of cooling and heating and various operation modes can be performed without a distributor, and manufacturing costs, installation costs, and installation space can be reduced.

According to at least one of the embodiments of the present disclosure, a simultaneous air conditioner capable of controlling indoor units for each group can be provided.

According to at least one of the embodiments of the present disclosure, optimal operation can be effectively performed according to the load generated in a plurality of indoor units.

According to at least one of the embodiments of the present disclosure, there is a technical advantage of being able to operate in response to load changes occurring in a plurality of indoor units.

According to at least one of the embodiments of the present disclosure, high-efficiency heat recovery operation is possible while simultaneously implementing hot water heating and cooling operations.

Although the present disclosure has been described with reference to specific embodiments shown in the drawings, it is apparent to those skilled in the art that the present description is not limited to those exemplary embodiments and is embodied in many forms without departing from the scope of the present disclosure, which is described in the following claims. These modifications should not be individually understood from the technical spirit or scope of the present disclosure.

What is claimed is:

1. An air conditioner, comprising:

one or more outdoor units comprising a compressor and an outdoor heat exchanger that exchanges heat between a refrigerant flowing through the compressor and external air;

a plurality of indoor units that is connected to the one or more outdoor units and has an indoor heat exchanger, wherein the plurality of indoor units comprises a first indoor unit group and a second indoor unit group, wherein the one or more outdoor units and the first indoor unit group are connected by a first gas pipe and a liquid pipe, and wherein the one or more outdoor units and the second indoor unit group are connected by a second gas pipe and the liquid pipe; and a first switching valve that switches the outdoor heat exchanger to a condenser or an evaporator; and a second switching valve that switches the second gas pipe into a high-pressure pipe or a low-pressure pipe, wherein when the first indoor unit group performs a heating operation and the second indoor unit group performs a cooling operation, if a heating load of the first indoor unit group is larger than a cooling load of the second indoor unit group, the first switching valve is turned on, and the outdoor heat exchanger is used as an evaporator.

2. The air conditioner of claim 1, wherein the first gas pipe flows a high-temperature and high-pressure refrigerant or a low-temperature and low-pressure refrigerant, depending on an operation mode of the first indoor unit group, and the second gas pipe flows a high-temperature and high-pressure refrigerant or a low-temperature and low-pressure refrigerant, depending on an operation mode of the second indoor unit group.

3. The air conditioner of claim 1, wherein the outdoor heat exchanger is used as a condenser or evaporator, based on a load of the first and second indoor unit groups.

4. The air conditioner of claim 3, wherein a current mode of the outdoor heat exchanger is maintained, when a difference between an evaporation heat amount and a condensation heat amount required according to the load of the first and second indoor unit groups is in a heat balance state within a preset standard value.

5. The air conditioner of claim 4, wherein the one or more outdoor units comprises a plurality of heat exchangers, and in a case of not the heat balance state, when there exists a heat exchanger capable of switching a mode to the condenser or the evaporator, switches a mode of a corresponding heat exchanger, and maintains a current mode of the outdoor heat exchanger, when a heat exchanger capable of switching a mode to the condenser or the evaporator does not exist.

6. The air conditioner of claim 4, wherein the one or more outdoor units comprises a plurality of outdoor units, and wherein operation modes of the plurality of outdoor units are sequentially changed one by one.

7. The air conditioner of claim 1, further comprising a switching valve which transmits a refrigerant discharged from the compressor to at least one of the outdoor heat exchanger and an indoor heat exchanger disposed inside the plurality of indoor units.

8. The air conditioner of claim 1, wherein the first indoor unit group is comprised of a dedicated heating indoor unit, and wherein the first gas pipe flows a high-temperature and high-pressure refrigerant, when the first indoor unit group is operated.

9. The air conditioner of claim 8, wherein when the second indoor unit group performs a heating operation, the second gas pipe flows a high-temperature and high-pressure refrigerant, and wherein when the second indoor unit group performs a cooling operation, the second gas pipe flows a low-temperature and low-pressure refrigerant.

10. An air conditioner, comprising:

one or more outdoor units comprising a compressor and an outdoor heat exchanger that exchanges heat between a refrigerant flowing through the compressor and external air;

a plurality of indoor units that is connected to the one or more outdoor units, and have an indoor heat exchanger, wherein the plurality of indoor units comprises a first indoor unit group comprised of a dedicated heating indoor unit and a second indoor unit group comprised of an indoor unit for both heating and cooling, wherein the one or more outdoor units and the first indoor unit group are connected by a first gas pipe and a liquid pipe, wherein the one or more outdoor units and the second indoor unit group are connected by a second gas pipe and the liquid pipe; and a first switching valve that switches the outdoor heat exchanger to a condenser or an evaporator; and a second switching valve that switches the second gas pipe into a high-pressure pipe or a low-pressure pipe, wherein when the first indoor unit group performs a heating operation and the second indoor unit group performs a cooling operation, if a heating load of the first indoor unit group is larger than a cooling load of the second indoor unit group, the first switching valve is turned on, and the outdoor heat exchanger is used as an evaporator.

11. The air conditioner of claim 10, wherein when the second indoor unit group performs a heating operation, the second gas pipe flows a high-temperature and high-pressure refrigerant, and wherein the second indoor unit group performs a cooling operation, the second gas pipe flows a low-temperature and low-pressure refrigerant.

12. The air conditioner of claim 10, wherein the first gas pipe flows a high-temperature and high-pressure refrigerant when the first indoor unit group is operated.

* * * * *